US005682305A

United States Patent [19]

Kurokami et al.

[11] Patent Number: 5,682,305

[45] Date of Patent: Oct. 28, 1997

[54] METHOD AND APPARATUS FOR CONTROLLING THE POWER OF A BATTERY POWER SOURCE

[75] Inventors: Seiji Kurokami; Nobuyoshi Takehara, both of Kyoto-fu, Japan

[73] Assignee: Canon Kabushiki Kaisha, Japan

[21] Appl. No.: 338,773

[22] Filed: Nov. 10, 1994

[30] Foreign Application Priority Data

| | | | |
|---|---|---|---|
| Nov. 16, 1993 | [JP] | Japan | 5-286877 |
| Sep. 20, 1994 | [JP] | Japan | 6-224962 |

[51] Int. Cl.[6] ..... G05F 5/00

[52] U.S. Cl. ..... 363/79; 323/906; 323/299

[58] Field of Search ..... 62/235; 323/906, 323/299; 363/80

[56] References Cited

U.S. PATENT DOCUMENTS

| | | | |
|---|---|---|---|
| 4,390,940 | 6/1983 | Corbefin et al. | 363/132 |
| 4,649,334 | 3/1987 | Nakajima | 323/299 |
| 4,899,269 | 2/1990 | Rouzies | 363/41 |
| 4,916,382 | 4/1990 | Kent | 323/299 |
| 5,235,266 | 8/1993 | Schaffrin | 323/906 |
| 5,375,429 | 12/1994 | Tokizaki et al. | 62/235.1 |

FOREIGN PATENT DOCUMENTS

| | | |
|---|---|---|
| 0027405 | 4/1981 | European Pat. Off. . |
| 0140149 | 5/1985 | European Pat. Off. . |
| 0326489 | 8/1989 | European Pat. Off. . |
| 0628901 | 12/1994 | European Pat. Off. . |
| 2686434 | 7/1993 | France . |
| 87-042213 | 2/1987 | Japan . |
| 62-85312 | 4/1987 | Japan . |
| 87-085312 | 4/1987 | Japan . |
| WO87/00312 | 1/1987 | WIPO . |

OTHER PUBLICATIONS

Gwonjong Yu et al. 'Application of Instantaneous Sinusoidal Current Tracking Control Inverter to Photovoltaic System', Proceedings of the International Photovoltaic Science and Engineering Conference, Nov. 26 1990, pp. 661–664.

*Primary Examiner*—Peter S. Wong
*Assistant Examiner*—Shawn Riley
*Attorney, Agent, or Firm*—Fitzpatrick, Cella, Harper & Scinto

[57] ABSTRACT

A power control method and apparatus for extracting the maximum power from a battery power source are disclosed. Voltage signals and current signals are read while varying the operating point of a solar cell acting as the battery power source. The variation in the intensity of solar radiation that has occurred during a sampling time interval is estimated from a plurality of current signals, sampled at the same voltage, or, according to a plurality of power values, calculated from current signals and voltage signals. Based on the estimated variation in the intensity of solar radiation, the current signals or power signals are corrected. According to the corrected current signals or according to the corrected power values and the voltage values, the operating point is controlled so that the maximum output power is provided from the solar cell.

9 Claims, 16 Drawing Sheets

METHOD AND APPARATUS FOR CONTROLLING THE POWER OF A BATTERY POWER SOURCE

BACKGROUND OF THE INVENTION

1. Field of the Invention

The present invention relates to a method and apparatus for controlling the power of a battery power system having a power conversion circuit, and particularly, to a method and apparatus for controlling the power of a battery power source so that more output power can be extracted from the battery power source. The present invention also relates to a measurement method associated with measuring equipment for measuring voltage-versus-current output characteristics of a power source.

2. Description of the Related Art

The global environment has become a serious problem. To solve this problem, one of promising clean energy sources is a battery power system, such as a solar cell, aerogenerator, etc. When a solar cell is used as a battery power source that is connected to an utility grid, the utility grid acts as a substantially infinite load. Under this condition, it is required to establish a technique that can provide the highest efficiency in the operation of the battery power system as a whole. Not only should the total efficiency of the battery power system be high, but also the total power system including the utility grid should have high efficiency. Thus, it is required to establish a technique to achieve the highest efficiency in the total power system. In a solar cell, since it is based on photoelectric conversion, the output power greatly depends on the intensity of solar radiation, temperature, or the voltage at the operating point. Therefore, the load seen from the solar cell system should be adjusted such that the solar cell system can always provide the maximum power. One of the techniques known for the above purposes is to change the operating-point voltage or current of a solar cell array, including a plurality of solar cells, and to detect the resultant change in power thereby determining the optimum operating point for the solar cell array to provide the maximum, or nearly maximum, power. One of techniques of this kind is disclosed in Japanese Patent No. 63-57807, that is based on the derivative of the power with respect to the voltage. Another technique of this kind is the so-called "hill-climbing method" in which the optimum operating point is searched by varying the power in a direction that leads to an increase in the power, as disclosed, for example, in Japanese Patent Laid-Open No. 62-85312. These methods are widely used in conventional solar cell systems to control a power conversion apparatus so as to provide the maximum power.

Conventionally, the voltage-current output characteristic of a solar cell system is measured using an electronic-load method, or a capacitor-load method, in which operating-point voltages and currents are sampled while varying the operating point of the solar cell system, from a short-circuit condition to an open-circuit condition, or, in the opposite direction.

However, the conventional methods have the following problems.

In the hill-climbing method, when the voltage is initially set to V1, shown in FIG. 14 (wherein the horizontal axis represents voltage V, and the vertical axis represents power P), and the voltage is increased, if the intensity of solar radiation increases, then the following problem occurs.

When the voltage is set to V1, voltage V1 and current I1 at an operating point (1) are sampled or read at time t1, and then the output power P1 at this time is calculated.

Then, the voltage is changed and set to V2. At time t2, which is later by the sampling interval Ts than time t1, sampling is performed again and voltage V2 and current I2 at an operating point (2) are read, and then the output power P2 at this time is calculated (the operating point will be at the point represented by an open circle with a broken line if no change in the solar-radiation intensity occurs).

If the intensity of solar radiation is constant, the decision that the voltage should be decreased will be made judging from the operation point (1) and the open circle. However, if the intensity of solar radiation increases during the time period between the sampling times t1 and t2, the increase in power from P1 to P2 will lead to an incorrect decision that the voltage should be increased. In this case, the correct decision would be that the voltage should be decreased, as can be seen from the voltage operating point (2) lying on the V-P curve at time t2. As a result of the incorrect decision, the searching is further done in the direction that leads to a lower operating voltage, and thus the instantaneous output efficiency decreases (the instantaneous output efficiency is defined as the ratio of the output power to the maximum available power at an arbitrary time).

If the intensity of light increases further, then the operating voltage increases further, and thus the instantaneous output efficiency decreases to a very low level. As a result, the output efficiency also decreases (the output efficiency is defined as the ratio of the output power to the maximum available power during a certain time duration).

In the above example, the output voltage increases. However, the output voltage may decrease or may remain at the same value as a result of an incorrect decision.

Sometimes, an erroneous operation of the power control system, such as that described above, leads to an abrupt decrease in the output voltage of the solar cell system, and causes a protection circuit to undesirably shutdown a power conversion apparatus.

In the above example, the operation is performed according to the hill-climbing method. The power control method based on the derivative of the power with respect to the voltage also has a similar problem. In any case, there is a possibility that a reduction in the output efficiency or other instability may occur in a solar cell system due to changes in conditions such as a change in the intensity of solar radiation during a sampling interval. In the measurement of the voltage-current output characteristic of a solar cell system, if the measurement is performed under the conditions where the intensity of light incident on the solar cell system changes during the measurement, it is impossible to perform accurate measurement.

SUMMARY OF THE INVENTION

It is an object of the present invention to provide an improved power control method that can stably extract the maximum power from a solar cell system without any problems such as those encountered in conventional techniques. In is an another object of the present invention to provide a method for accurately measuring the voltage-current output characteristic of a solar cell system.

According to one aspect of the present invention, there is provided a power control apparatus comprising voltage detection means for detecting the voltage value of a battery power source, current detection means for detecting the current value of the battery power source, power conversion means for converting the power supplied by the battery power source and then supplying the converted power to a load, output value setting means for setting an output value according to the current value and the voltage value, and power control means for controlling the power conversion means according to the output value associated with the maximum output power that has been set by the output value setting means. The power control apparatus is characterized in that the output value setting means comprises means for changing the operating point of the battery power source and detecting a plurality of current values at least at one voltage value and then storing the voltage value and the plurality of current values or power values, correction value detecting means for making a comparison between the plurality of current values or between the plurality of power values thereby detecting a correction value associated with an output variation at the same voltage and output setting means for setting an output power value according to the plurality of current values or the plurality of power values and the correction value associated with the output variation.

According to another aspect of the present invention, there is provided a power control method for controlling an apparatus, the apparatus comprising a battery power source, a power conversion apparatus for converting the power supplied by the battery power source and then supplying the converted power to a load, voltage detection means for detecting the voltage of the battery power source, current detection means for detecting the current of the battery power source, and control means for controlling the power conversion apparatus according to the values detected by the voltage detection means and by the current detection means. The power control method is characterized in that it comprises the steps of changing the operating point of the battery power source and then reading the voltage and the current, detecting a variation in current or power that has occurred during a sampling interval, from a plurality of current values at the same voltage or from power values calculated from the plurality of current values and the voltage value, making a calculation using the variation and the plurality of current values or power values to obtain a corrected current value or corrected power value and controlling the operating point according to the corrected current values or corrected power values so that the maximum power is extracted from the battery power source.

According to another aspect of the present invention, there is provided a method for measuring a voltage-versus-current output characteristic of a battery power system comprising a battery power source, voltage detection means for detecting the output voltage of the battery power source, current detection means for detecting the output current of the battery power source and voltage control means for controlling the output voltage of the battery power source. The method is characterized in that currents are sampled a plurality of times at the same voltage, a variation in current that has occurred during the sampling time interval is estimated from a plurality of current signals detected at the same voltage and the current signals are corrected using the estimated variation in current.

In the method for measuring a voltage-versus-current output characteristic of a battery power source, a variation in current or power that has occurred during a sampling time interval is estimated from a change in current or power at the same voltage, and current signals or power values are corrected using the estimated variation in current or power. Thus, data lying on a correct I-V curve at an arbitrary given time can be obtained regardless of variations of parameters such as the intensity of solar radiation. As a result, the optimum operating point at which the maximum output power is obtained can be correctly searched regardless of the variation in the intensity of solar radiation. Furthermore, since the sampling operation is required to be done only twice at the same voltage, it is possible to quickly search the optimum operating point with the minimum number of sampling operations. If sampling operations for the same voltage are done first and last in each sampling cycle, the information of the change in the intensity of solar radiation that occurs during a time interval from the start of a sampling cycle to the end of the cycle can be obtained, and therefore more accurate correction can be performed on the data.

In a power control method according to the present invention, since a variation in current or power that has occurred during a sampling time interval is estimated from a difference in current or power at the same voltage, and current signals or power values are corrected using the estimated variation in current or power, data lying on a correct I-V curve at an arbitrary given time can be obtained, regardless of variations of parameters such as the intensity of solar radiation, thereby searching the optimum operating point at which the maximum output power is obtained. As a result, the maximum power can always be extracted from the battery power source, without any instability in operation, regardless of the variation in the intensity of solar radiation.

DESCRIPTION OF THE PREFERRED EMBODIMENTS

The present invention is based on the knowledge that in a searching operation for the maximum power of a battery power source, apparent displacement of a characteristic curve, such as a P-I curve or V-I curve, occurs to a rather larger degree during each sampling interval Ts, while the change in the apparent shape of the characteristic curve during this interval Ts is rather small. The apparent displacement of the characteristic curve occurs at a substantially constant rate during the sampling interval Ts. A good approximation or correction of a characteristic curve at an arbitrary time can be obtained from values sampled at sampling intervals Ts. Power control can be successfully performed on the basis of this corrected characteristic to achieve high efficiency in a total system. In the power control of a solar cell, it is impossible to sample voltages or currents associated with the solar cell at a plurality of operating points at the same time. Inevitably, it takes a finite time, determined by a sampling interval Ts, to obtain a plurality of data. Therefore, if correction is not performed, a quick change in the intensity of solar radiation can cause a problem in the power control of the solar cell.

Referring to the accompanying drawings, the present invention will now be described in detail.

Figure 1:
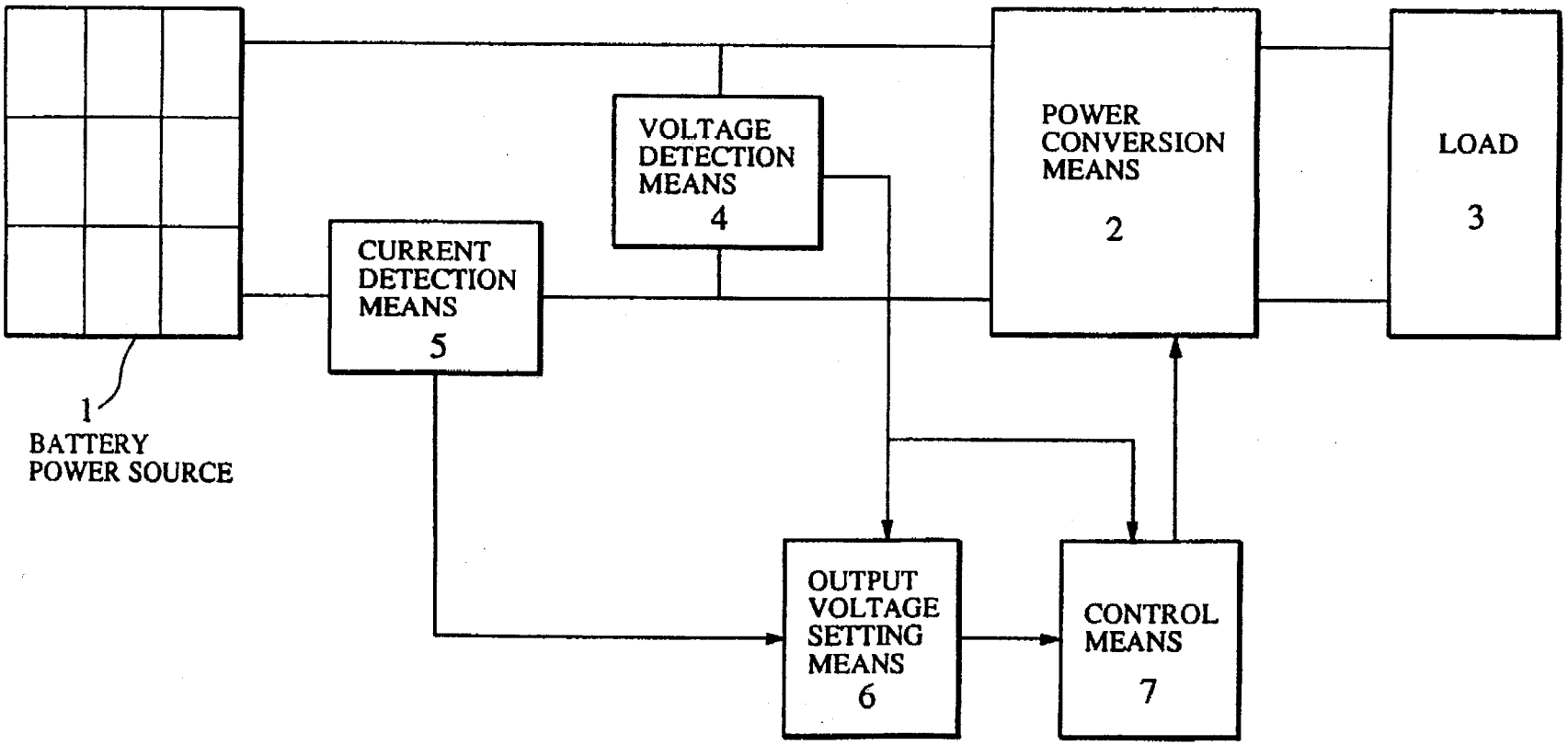
FIG. 1 is a schematic diagram illustrating an example of a battery power system using a power control method according to the present invention.

FIG. 1 illustrates an electric power generating system, using solar energy, based on a power control method of the present invention. The DC power of a solar cell 1, serving as a battery power source, is subjected to power conversion at a power conversion apparatus 2, serving as power conversion means, and is then supplied to a load 3.

Battery Power Source

The battery power source 1 can be implemented with a solar cell comprising a semiconductor, such as amorphous silicon, micro-crystal silicon, crystalline silicon, single-crystal silicon, compound semiconductor, or the like. In general, a plurality of solar cells are combined in a series-and-parallel form and arranged in an array or string form so that a desired voltage and a desired current are obtained.

Power Conversion Means

The power conversion means 2 can be implemented by a DC/DC converter constructed with a switching device of the self extinction type such as a power transistor, power MOS FET, IGBT, GTO, etc., or a self excited DC/AC inverter. In the power conversion means 2, the power flow, input and output voltage, and output frequency are controlled by adjusting the duty factor or the on/off ratio of the gate pulse.

Load

The load 3 can be an electric heating system, an electric motor, a commercial AC system, etc., or combinations of these loads. When the load is a commercial AC system, the solar cell system is called a grid connection solarlight power generation system. In this case, since there is no limitation in the power that the AC system can accept, the power control method of the present invention can be advantageously used to extract the maximum power from the battery power source.

Voltage Detection Means and Current Detection Means

The output voltage and the output current of the battery power source 1 are sampled using conventional voltage detection means 4 and current detection means 5. The voltage signal, detected in the form of digital data, is applied to output voltage setting means 6 and control means 7. The detected current signal is applied to the output voltage setting means 6. In the case of the AC output current or the AC output voltage, the average value is determined from instantaneous values.

Output Voltage Setting Means

The output voltage setting means 6 determines a target voltage from the voltage signals and current signals that have been detected and stored, and adjusts the duty factor or the on/off ratio so that the output voltage of the solar cell system is maintained at the target voltage. The output voltage setting means 6 is implemented by a microcomputer including a CPU, RAM, I/O circuit, etc.

Control Means

The control means 7 is the so-called gate driving circuit that generates a PWW pulse to drive the gate according to, for example, the triangular wave comparison method or the instantaneous current tracking control method, whereby the on/off duty factor of the power conversion means 2 is controlled to control the output voltage of the solar cell system.

Embodiment 1

Figure 2:
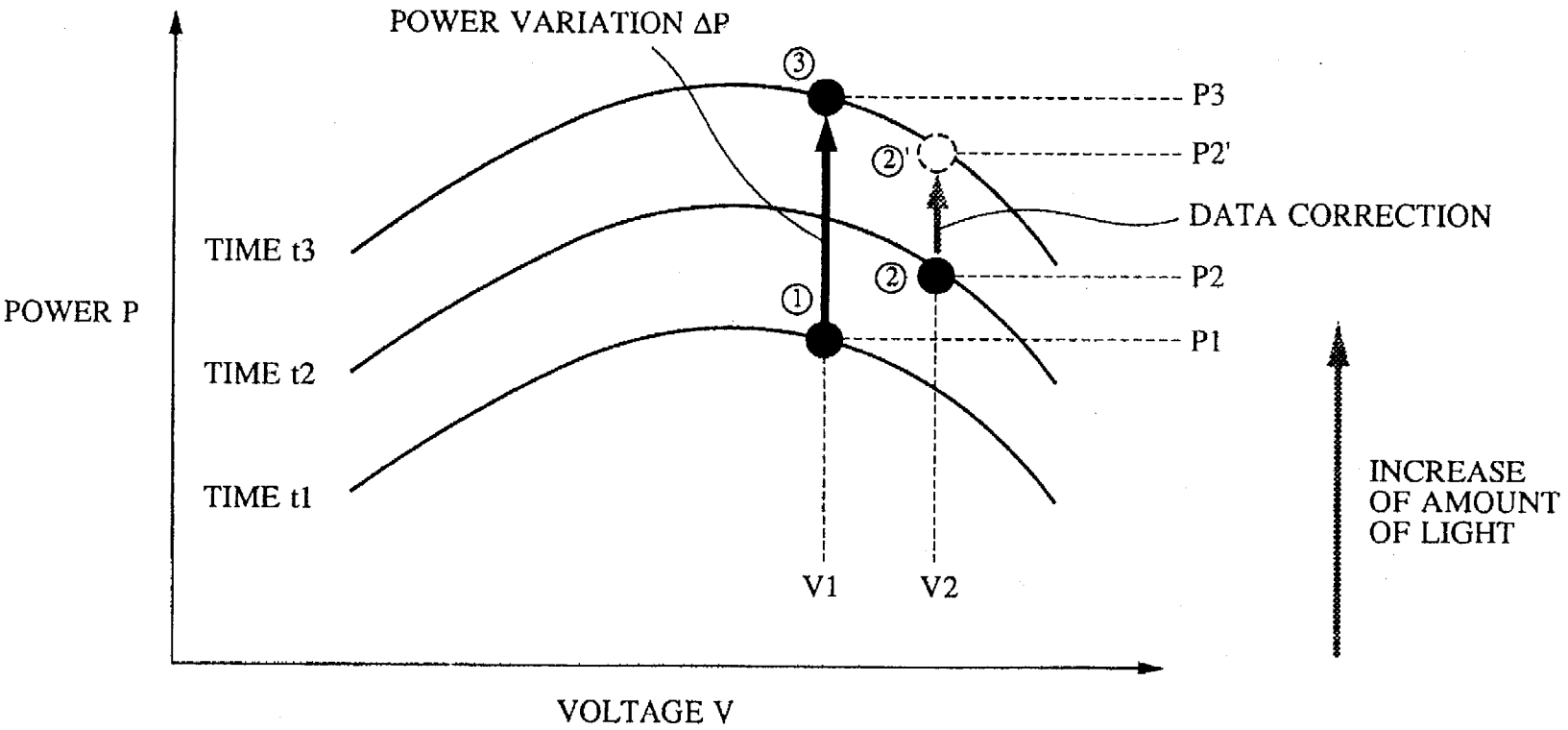
FIG. 2 is a graph illustrating an example of searching of an optimum operating point according to the power control method of the present invention.

Referring to FIG. 2, a method for searching the operating point that gives the maximum power, using the hill-climbing technique, will be described. FIG. 2 illustrates voltage-power output characteristics at different times, in which the horizontal axis represent the voltage V, and the vertical axis represents the power P. As can be seen from FIG. 2, the change in the apparent shape of the V-P curve is small.

First, the operating point is set to voltage V1. Sampling is done at time t1 so as to read voltage V1 and current I1 at the operating point (1), and then the output power P1 (=V1×I1) is calculated.

Operating Point (1): Voltage=V1; Power=P1

Then, the operating point is set to voltage V2, and voltage V2 and current I2 at the operating point (2) are read at the next sampling time t2 (=t1 +Ts), and the output power P2 (=V2×I2) is calculated.

Operating Point (2): Voltage=V2; Power=P2

The operating point is set to voltage V1 again, and voltage V3 (=V1) and current I3 at the operating point (3) are read at the next sampling time t3 (=t2+Ts), and the output power P3 (=V3×I3) is calculated.

Operating Point (3): Voltage=V3; Power=P3

Then, the variation in the intensity of solar radiation is estimated from the difference between the power obtained at two operating points having the same voltage V1. That is, since the output current or the output power of the solar cell system changes in proportion to the intensity of the solar radiation as long as the output voltage is maintained constant, the difference in power for the same output voltage indicates the change in the intensity of solar radiation that has occurred during the measuring interval. Therefore, the power difference ΔP=P3−P1 represents the change in the intensity of solar radiation that has occurred during the interval from time t1 to time t3. (This means that the apparent displacement of the characteristic curve per searching time interval is rather great, and the displacement of the characteristic curve occurs at a nearly constant rate during each searching time interval.)

In view of the above, the data is corrected using ΔP which includes the information representing the change in the intensity of solar radiation.

The sampling interval Ts is preferably less than 1 sec, and more preferably less than 1/30 sec, so that the intensity of solar radiation can be considered to change at a constant rate during the time interval from t1 to t3 (the interval is assumed to be 1/30 sec in the following discussion). In the vicinity of the operating point that results in the maximum output power, the difference between the output power at voltage V1 and the output power at voltage V2 is so small that the changing rate in the apparent displacement of the output power curve, arising from the change in the intensity of solar radiation during a time interval of the order of the sampling interval Ts, can be regarded as constant for both operating points at V1 and V2.

Therefore, power P2 at the operating voltage V2 at time t2 can be corrected to power P2', at the operating voltage V2 at time t3, by adding ΔP/2 to power P2 wherein ΔP/2 corresponds to the power change arising from the change in the intensity of solar radiation that has occurred during the time interval from t2 to t3.

$$P2'=P2+\Delta P/2$$

This corrected operating point is denoted by (2)' in FIG. 2.

Operating Point (2)': Voltage=V2; Power=P2'

Then, the power at the operating point (3) is compared with the power at the operating point (2)', and the next searching direction is determined from the result of the above comparison. Power P3 at the operating point (3) is greater than power P2' at the operating point (2)'. This means that the maximum power will be obtained at an operating voltage less than the operating voltage V1, which will lead to a decision that the next searching should be done in the direction that results in a reduction in voltage.

Figure 3:
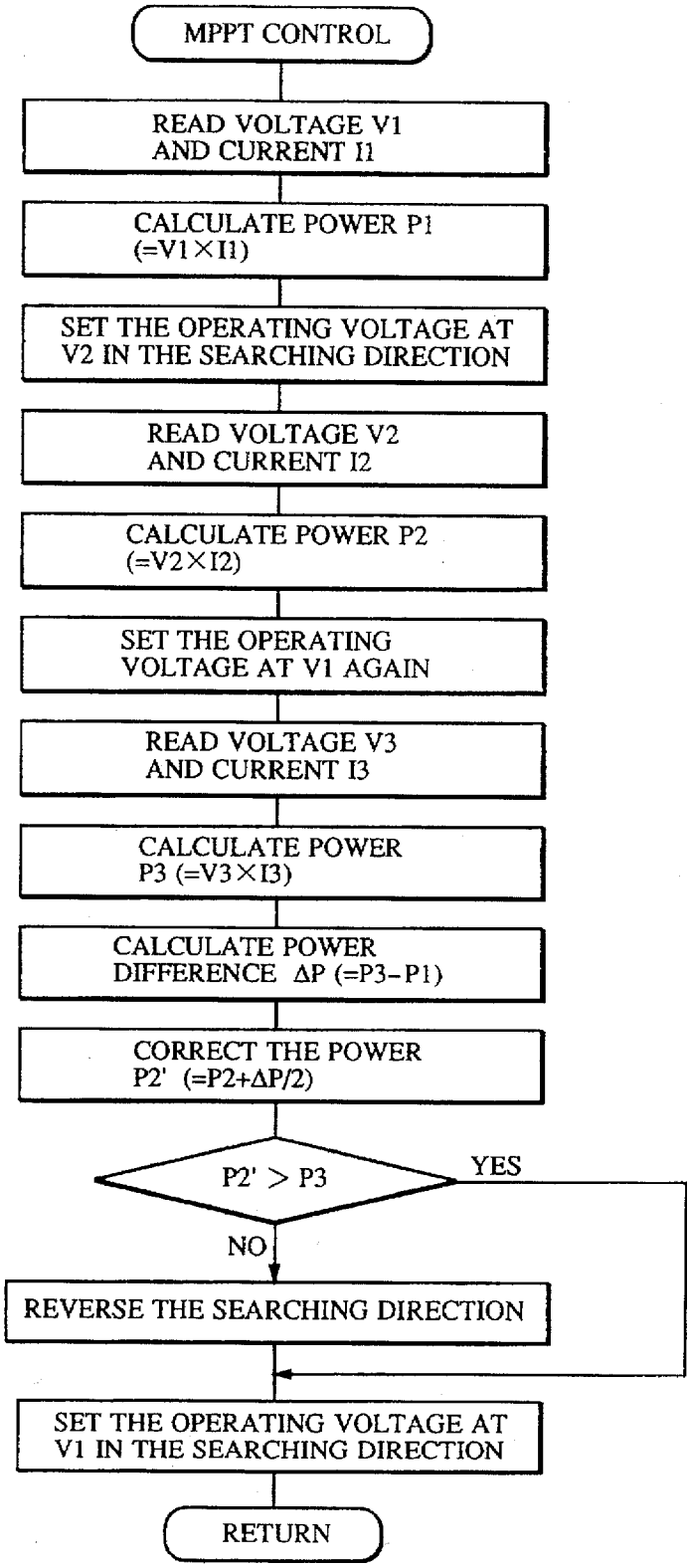
FIG. 3 is a flow chart illustrating the control process shown in FIG. 2.

The above-described process is done repeatedly so that the operating point is always at the optimum point that produces the maximum power. FIG. 3 is a flow chart illustrating this process.

In the above example, the operation has been described referring to the case in which the intensity of light increases. However, it will be apparent to those skilled in the art that the operating point is always at the optimum point that provides the maximum output power also in the case where the intensity of light decreases or remains unchanged.

The power control method of the present embodiment has been applied to a solar cell system including twelve amorphous solar cell modules, produced by USSC Corp. (Product Number: UPM880), wherein these solar cell modules are connected in series. This solar cell system has been continuously operated under varying solar radiation, wherein the optimum operating point is searched by varying the voltage in steps of 2 V at sampling intervals of 1/30 sec. Under the above conditions, the solar cell system has shown output efficiency (the ratio of the output power to the maximum available output power) as high as 99.99%. In contrast, in the solar cell system controlled according to the conventional hill-climbing method, in which data correction is not performed, the output efficiency was 98.86% under the same conditions. The above results indicate that the system having a relatively simple construction according to the present invention can provide improvement in the efficiency by about 1.13%.

In the present embodiment, as described above, the variation in the intensity of solar radiation is estimated from power values obtained at the same output voltage at different times, thereby obtaining correct data, lying on a correct output characteristic curve, at any given time. Since the searching direction is determined from the data obtained in this way, no erroneous operation occurs in the searching control even if the intensity of solar radiation varies. As a result, the system can extract the maximum power from a solar cell system without instability.

Embodiment 2

A second embodiment will now be described.

Figure 4:
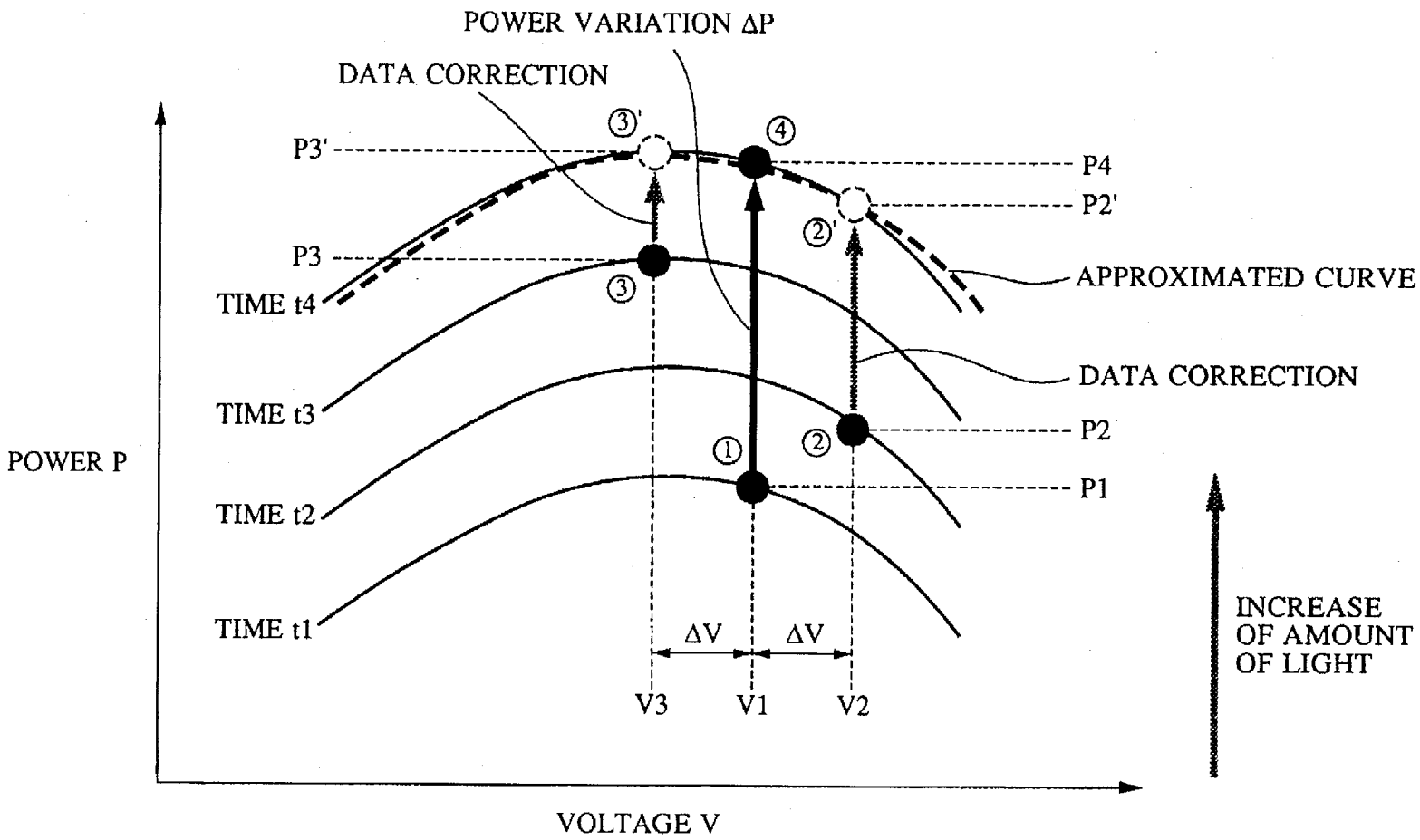
FIG. 4 is a graph illustrating another example of searching of an optimum operating point according to a power control method of the present invention.
Figure 5:
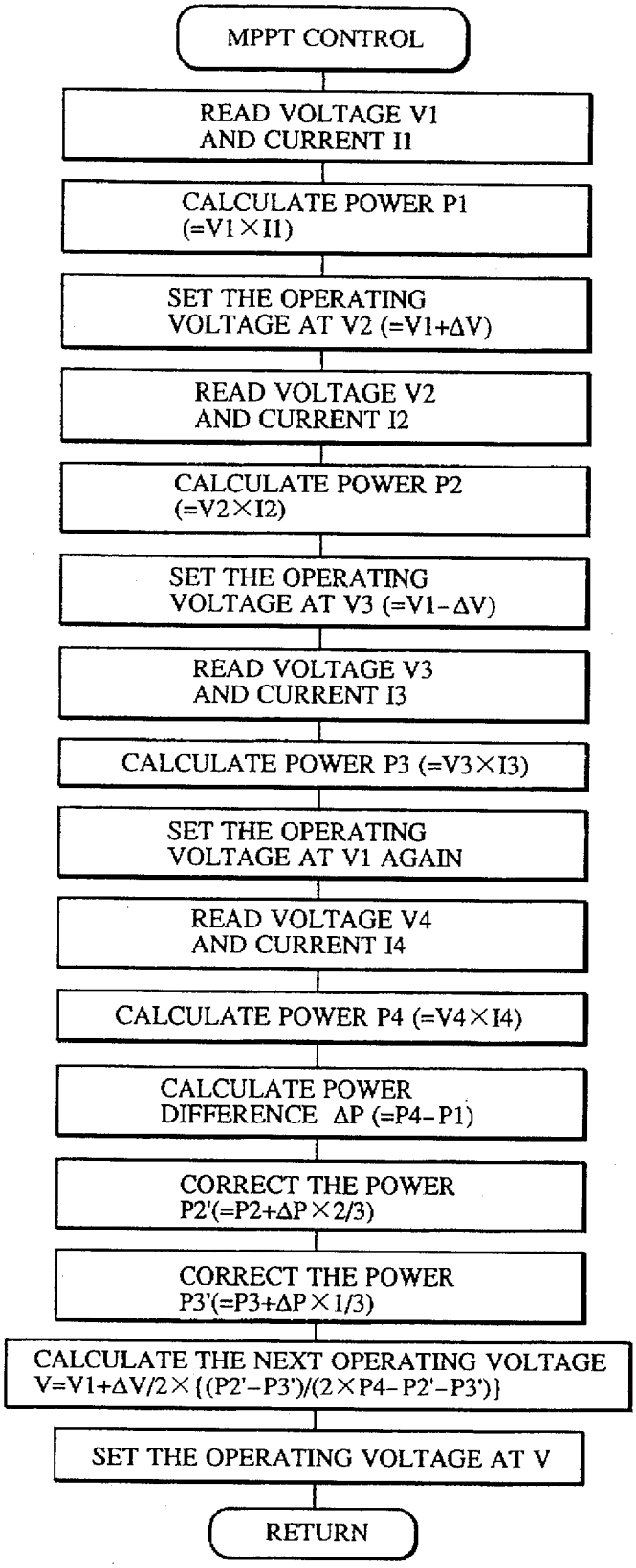
FIG. 5 is a flow chart illustrating the control process shown in FIG. 6.

In this embodiment, a solar cell power generation system, using a power control method according to the present invention, has a similar construction to that of embodiment 1 shown in FIG. 1. However, in this embodiment, the power control that will be described below, referring to FIG. 4, is based on a different method from that of embodiment 1. FIG. 4 illustrates voltage-power output characteristics at different times, in which the horizontal axis represent voltage V, and the vertical axis represents power P.

In a searching operation, the operating point is first set to voltage V1. Sampling is performed at time t1 so as to read voltage V1 and current I1 at the operating point (1), and then the output power P1 (=V1×I1) is calculated.

Operating Point (1): Voltage=V1; Power=P1

Then, the operating point is set to V2 (=V1 +ΔV), and voltage V2 and current I2 at the operating point (2) are read at the next sampling time t2(=t1+Ts), and the output power P2(=V2×I2) is calculated from these values.

Operating Point (2): Voltage=V2; Power=P2

Then, the operating point is set to voltage V3 (=V1−ΔV), and voltage V3 and current I3 at the operating point (3) are read at the next sampling time t3 (=t2+Ts), and the output power P3 (=V3×I3) is calculated from these values.

Operating Point (3): Voltage=V3; Power=P3

The operating point is set to voltage V1 again, and voltage V1(=V4) and current I4 at the operating point (4) are read at the next sampling time t4 (=t3 +Ts), and the output power P4(=V1×I4) is calculated from these values.

Operating Point (4): Voltage=V4; Power=P4

Figure 16:
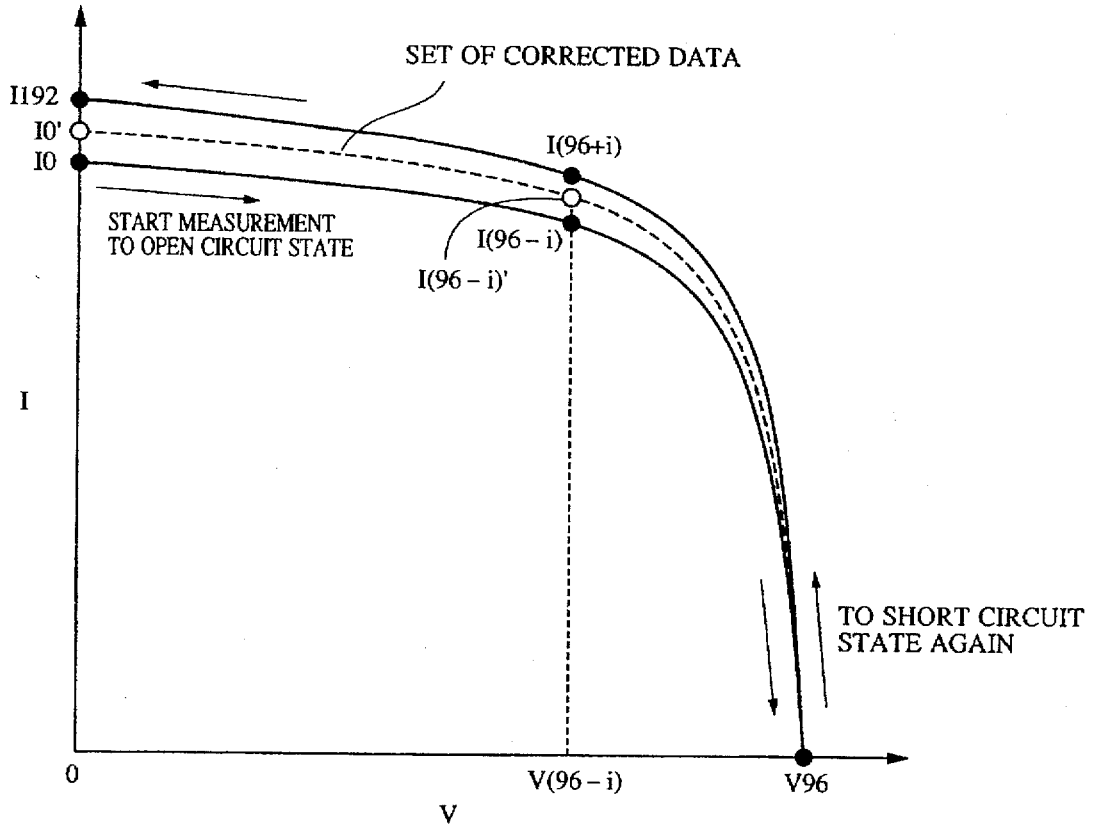
FIG. 16 is a graph illustrating an example of a measurement process according to the present invention.

Then, the variation in the intensity of solar radiation is estimated from the difference between the power obtained at two operating points having the same voltage V1. Since the output current or the output power of the solar cell system changes in proportion to the intensity of the solar radiation as long as the output voltage is maintained constant, the difference in power for the same output voltage indicates the FIG. 16 is a graph illustrating an example of a measurement process according to the present invention.

DESCRIPTION OF THE PREFERRED EMBODIMENTS

The present invention is based on the knowledge that in a searching operation for the maximum power of a battery power source, apparent displacement of a characteristic curve, such as a P-I curve or V-I curve, occurs to a rather larger degree during each sampling interval Ts, while the change in the apparent shape of the characteristic curve during this interval Ts is rather small. The apparent displacement of the characteristic curve occurs at a substantially constant rate during the sampling interval Ts. A good approximation or correction of a characteristic curve at an arbitrary time can be obtained from values sampled at sampling intervals Ts. Power control can be successfully performed on the basis of this corrected characteristic to achieve high efficiency in a total system. In the power control of a solar cell, it is impossible to sample voltages or currents associated with the solar cell at a plurality of operating points at the same time. Inevitably, it takes a finite time, determined by a sampling interval Ts, to obtain a plurality of data. Therefore, if correction is not performed, a quick change in the intensity of solar radiation can cause a problem in the power control of the solar cell.

Referring to the accompanying drawings, the present invention will now be described in detail.

FIG. 1 illustrates an electric power generating system, using solar energy, based on a power control method of the present invention. The DC power of a solar cell 1, serving as a battery power source, is subjected to power conversion at a power conversion apparatus 2, serving as power conversion means, and is then supplied to a load 3.

Battery Power Source

The battery power source 1 can be implemented with a solar cell comprising a semiconductor, such as amorphous silicon, micro-crystal silicon, crystalline silicon, single-crystal silicon, compound semiconductor, or the like. In general, a plurality of solar cells are combined in a series-and-parallel form and arranged in an array or string form so that a desired voltage and a desired current are obtained.

Power Conversion Means

The power conversion means 2 can be implemented by a DC/DC converter constructed with a switching device of the self extinction type such as a power transistor, power MOS FET, IGBT, GTO, etc., or a self excited DC/AC inverter. In the power conversion means 2, the power flow, input and output voltage, and output frequency are controlled by adjusting the duty factor or the on/off ratio of the gate pulse.

Load

The load 3 can be an electric heating system, an electric motor, a commercial AC system, etc., or combinations of these loads. When the load is a commercial AC system, the solar cell system is called a grid connection solarlight power generation system. In this case, since there is no limitation in the power that the AC system can accept, the power control method of the present invention can be advantageously used to extract the maximum power from the battery power source.

Voltage Detection Means and Current Detection Means

The output voltage and the output current of the battery power source 1 are sampled using conventional voltage detection means 4 and current detection means 5. The voltage signal, detected in the form of digital data, is applied to output voltage setting means 6 and control means 7. The detected current signal is applied to the output voltage setting means 6. In the case of the AC output current or the AC output voltage, the average value is determined from instantaneous values.

Output Voltage Setting Means

The output voltage setting means 6 determines a target voltage from the voltage signals and current signals that have been detected and stored, and adjusts the duty factor or the on/off ratio so that the output voltage of the solar cell system is maintained at the target voltage. The output voltage setting means 6 is implemented by a microcomputer including a CPU, RAM, I/O circuit, etc.

Control Means

The control means 7 is the so-called gate driving circuit that generates a PWW pulse to drive the gate according to, for example, the triangular wave comparison method or the instantaneous current tracking control method, whereby the on/off duty factor of the power conversion means 2 is controlled to control the output voltage of the solar cell system.

Embodiment 1

Referring to FIG. 2, a method for searching the operating point that gives the maximum power, using the hill-climbing technique, will be described. FIG. 2 illustrates voltage-power output characteristics at different times, in which the horizontal axis represent the voltage V, and the vertical axis represents the power P. As can be seen from FIG. 2, the change in the apparent shape of the V-P curve is small.

First, the operating point is set to voltage V1. Sampling is done at time t1 so as to read voltage V1 and current I1 at the operating point (1), and then the output power P1 (=V1×I1) is calculated.

Operating Point (1): Voltage=V1; Power=P1

Then, the operating point is set to voltage V2, and voltage V2 and current I2 at the operating point (2) are read at the next sampling time t2 (=t1 +Ts), and the output power P2 (=V2×I2) is calculated.

Operating Point (2): Voltage=V2; Power=P2

The operating point is set to voltage V1 again, and voltage V3 (=V1) and current I3 at the operating point (3) are read at the next sampling time t3 (=t2+Ts), and the output power P3 (=V3×I3) is calculated.

Operating Point (3): Voltage=V3; Power=P3

Figure 6:
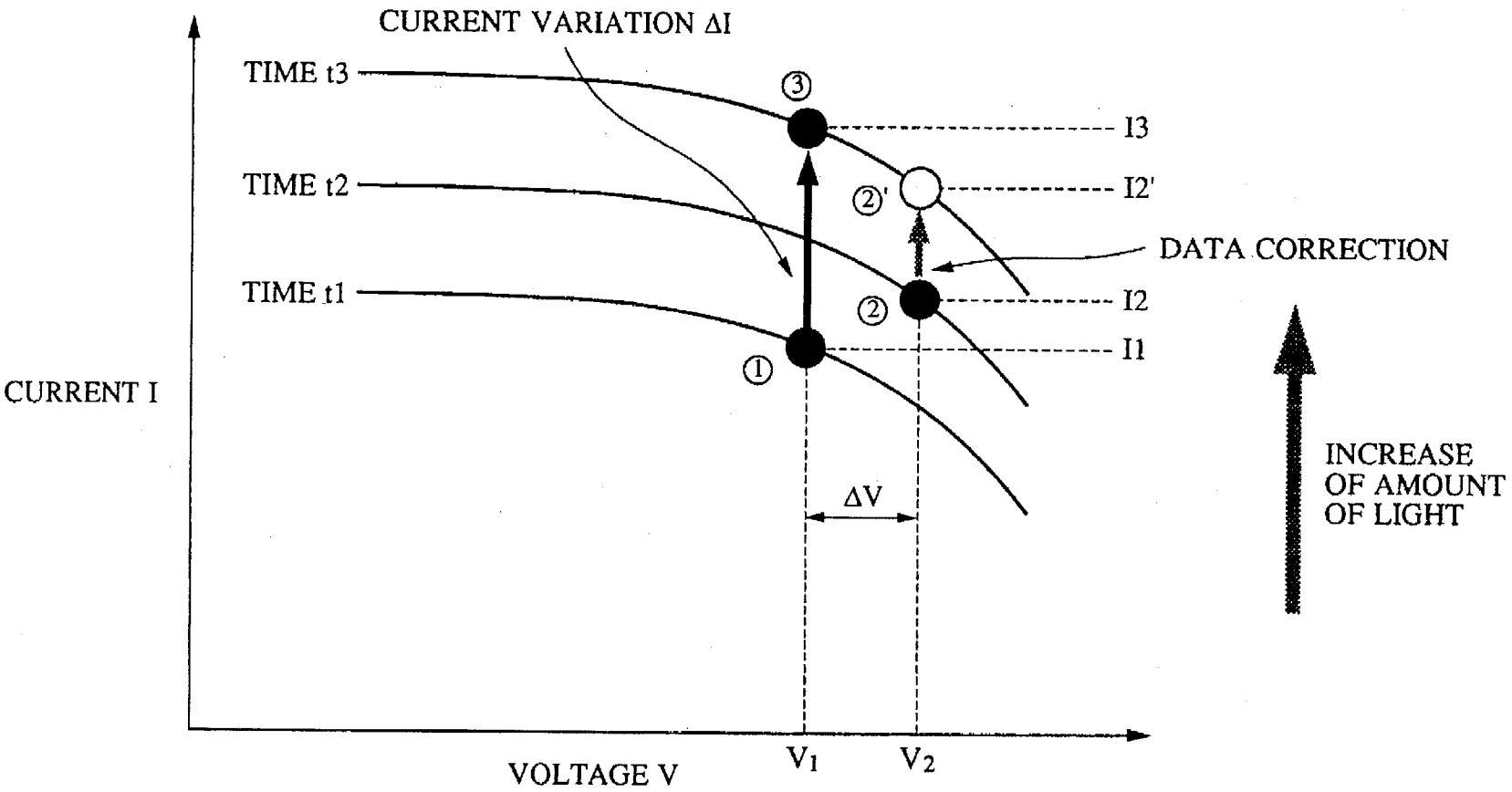
FIG. 6 is a graph illustrating still another example of searching of an optimum operating point according to a power control method of the present invention.

Then, the variation in the intensity of solar radiation is estimated from the difference between the power obtained at two operating points having the same voltage V1. That is, since the output current or the output power of the solar cell system changes in proportion to the intensity of the solar radiation as long as the output voltage is maintained constant, the difference in power for the same output voltage indicates the change in the intensity of solar radiation that has occurred during the measuring interval. Therefore, the invention also has a construction similar to those of embodiments 1 and 2 shown in FIG. 1. However, in this embodiment, the power control that will be described below, referring to FIG. 6, is based on a method different from those of the previous embodiments. FIG. 6 illustrates voltage-versus-current output characteristics at different times, in which the horizontal axis represent voltage V, and the vertical axis represents current I.

In a searching operation, the operating point is first set to voltage V1. Sampling is performed at time t1 so as to read voltage V1 and current I1 at the operating point (1).

Operating Point (1): Voltage=V1; Current=I1

Then the operating point is set to V2 (=V1+ΔV), and voltage V2 and current I2 at the operating point (2) are read at the next sampling time t2 (=t1+Ts).

Operating Point (2): Voltage=V2; Current=I2

The operating point is set to voltage V1 again, and voltage V1 (=V3) and current I3 at the operating point (3) are read at the next sampling time t3 (=t2+Ts).

Operating Point (3): Voltage=V3; Current=I3

Then, the apparent displacement of the voltage-versus-current curve, due to the variation in the intensity of solar radiation, is estimated from the difference between the currents obtained at the two operating points having the same voltage V1. Since the output current or the output power of the solar cell system changes in proportion to the intensity of the solar radiation, as long as the output voltage is maintained constant, the difference in power for the same output voltage indicates the change in the intensity of solar radiation that has occurred during the measuring interval. Therefore, the current difference, ΔI=I3−I1, represents the change in the intensity of solar radiation that has occurred during the interval from time t1 to time t3.

The data is corrected using ΔI which includes the information representing the difference in the intensity of solar radiation.

Because the sampling interval Ts is as short as 1/30 sec, the intensity of solar radiation can be considered to change at a constant rate during the time interval from t1 to t3. Therefore, current I2 at the operating voltage V2 at time t2 can be corrected to current I2' at the operating voltage V2 at time t3 by adding ΔI/2 to current I2 wherein ΔI/2 corresponds to the power change arising from the change in the intensity of solar radiation during the time interval from t2 to t3.

$$I2'=I2+\Delta I/2$$

This corrected operating point is denoted by (2)' in FIG. 6.

Operating Point (2): Voltage=V2; Current=I2

The next operating voltage is determined from the data associated with the operating points (2)' and (3) as follows.

Figure 7:
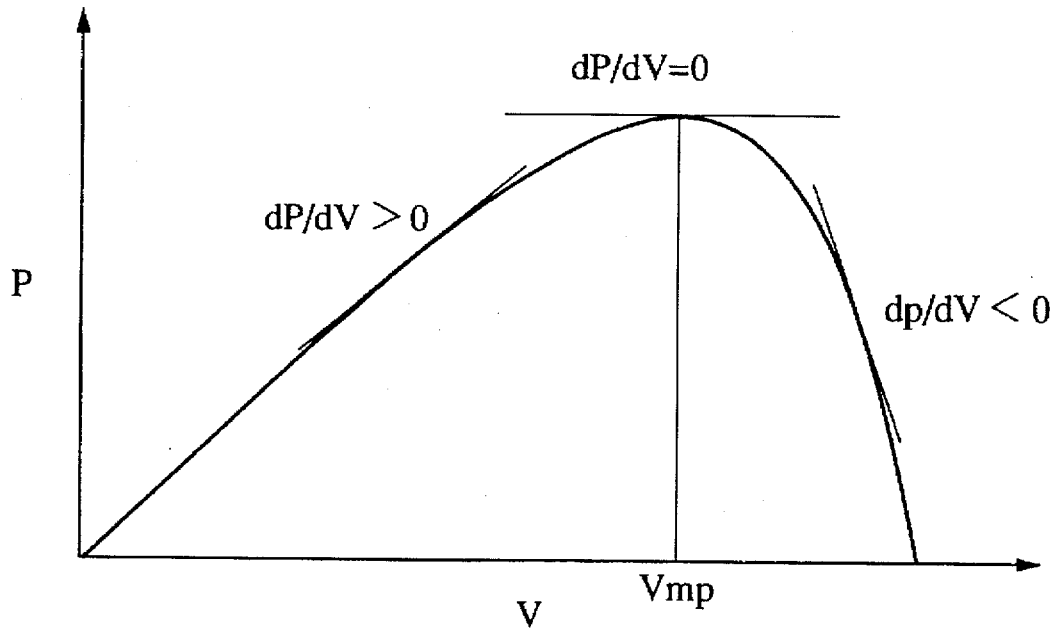
FIG. 7 is a graph illustrating a typical voltage-versus-power characteristic of a solar cell.

FIG. 7 illustrates a typical voltage-versus-power characteristic curve of a solar cell, in which the horizontal axis represent voltage and the vertical axis represents power. The gradient of the characteristic curve becomes zero at a point at which the output power has the maximum value. In the range in which the operating voltage is greater than the optimum voltage at which the output power has its maximum value, the gradient of the characteristic curve is negative. Contrarily, in the range in which the operating voltage is less than the optimum voltage at which the output power has its maximum value, the gradient of the characteristic curve is positive. That is, gradient dP/dV of the output characteristic curve is written as dP/dV=d(V×I)/dV=I+V×dI/d, and thus if dP/dV<0, then the operating voltage>the optimum voltage;

if dP/dV=0, then the operating voltage=the optimum voltage; and if dP/dV>0, then the operating voltage<the optimum voltage.

Here, if V1 and I3 are used as V and I, respectively, and furthermore, if dV=V1−V2, and dI=I3−I2', then dP/dV=I3+V1×(I3−I2')/(V1−V2). Using this equation, the next operating point is given by changing the operating voltage in the direction as follows:

if dP/dV<0 then the operating voltage is decreased;

if dP/dV=0 then the operating voltage is unchanged; and if dP/dV>0 then the operating voltage is increased.

In the specific example described above, it is assumed that the operating voltage should be increased.

Figure 8:
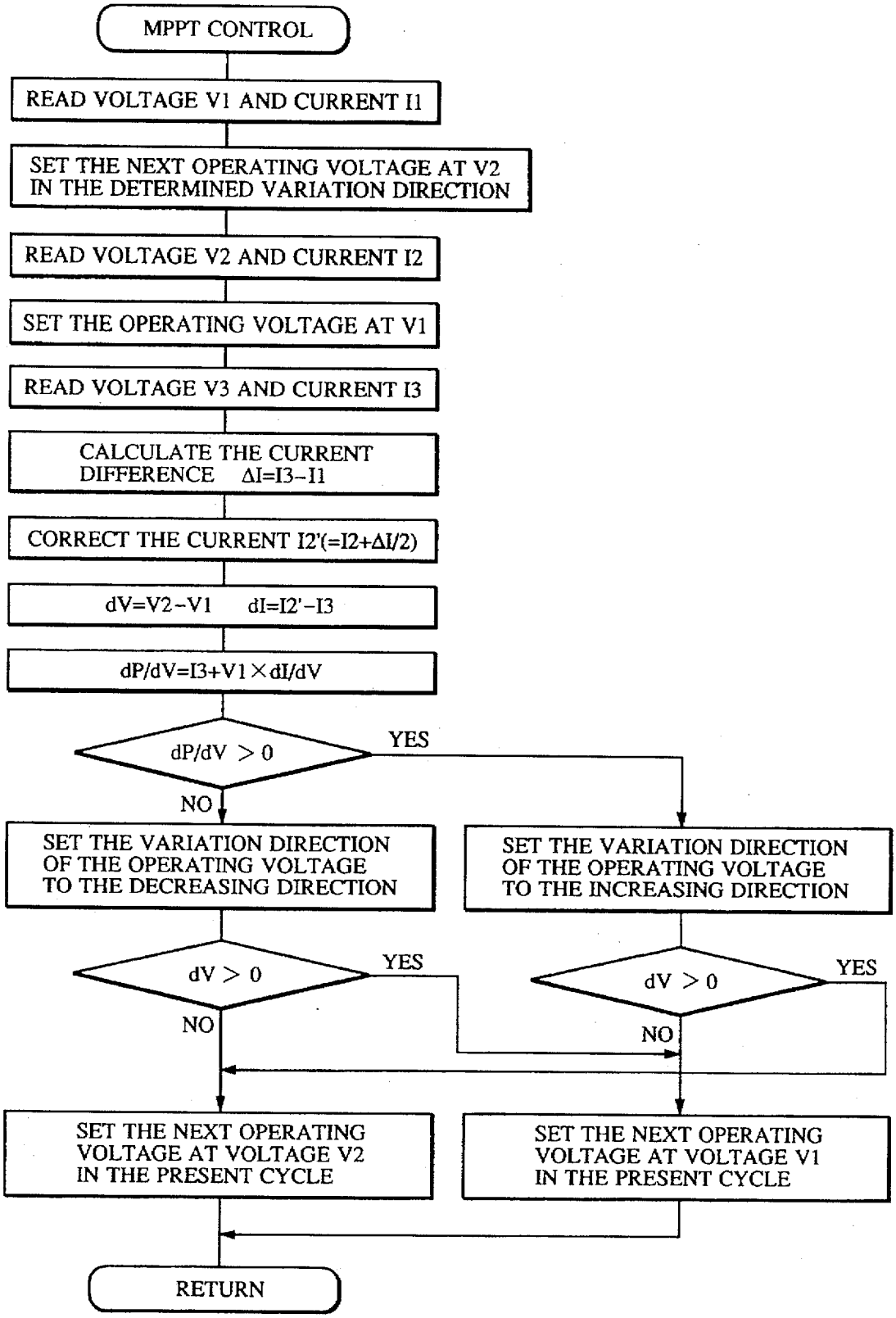
FIG. 8 is a flow chart illustrating the control process associated with FIG. 7.

The above-described process is done repeatedly so that the operating point is always at the optimum point that produces the maximum power. FIG. 8 is a flow chart illustrating this process.

In the above example, the operation has been described referring to the case where the intensity of light increases. However, it will be apparent to those skilled in the art that the operating point is always at the optimum point that provides the maximum output power also in the case where the intensity of light decreases or remains unchanged.

The power control method of the present embodiment has been applied to a solar cell system, including twelve amorphous solar cell modules produced by USSC Corp. (Product Number: UPM880), wherein these solar cell modules are connected in series. This solar cell system has been continuously operated under varying solar radiation, wherein the optimum operating point is searched by varying the voltage in steps of 2 V at sampling intervals of 1/30 sec. Under the above conditions, the solar cell system has shown output efficiency (the ratio of the output power to the maximum available output power) as high as 99.98%. In contrast, in the solar cell system controlled according to a conventional method in which data correction is not performed, the output efficiency was 98.86% under the same conditions.

In the present embodiment, as described above, the variation in the intensity of solar radiation is estimated from power values obtained at the same output voltage at different times, thereby obtaining correct data lying on a correct output characteristic curve at any given time. Since the starting voltage and the searching direction in the next searching cycle are determined from the data obtained in this way, no erroneous operation due to the change in the intensity of solar radiation occurs in the searching control. As a result, the system can extract the maximum power from a solar cell system without instability.

One of advantages of the systems described above is that since DC voltage detection means and DC current means can be used as the voltage detection means for detecting the voltage, and the current detection means for detection the current, respectively, the system can be constructed in a relatively simple fashion.

Embodiment 4

The fourth embodiment will now be described.

Figure 9:
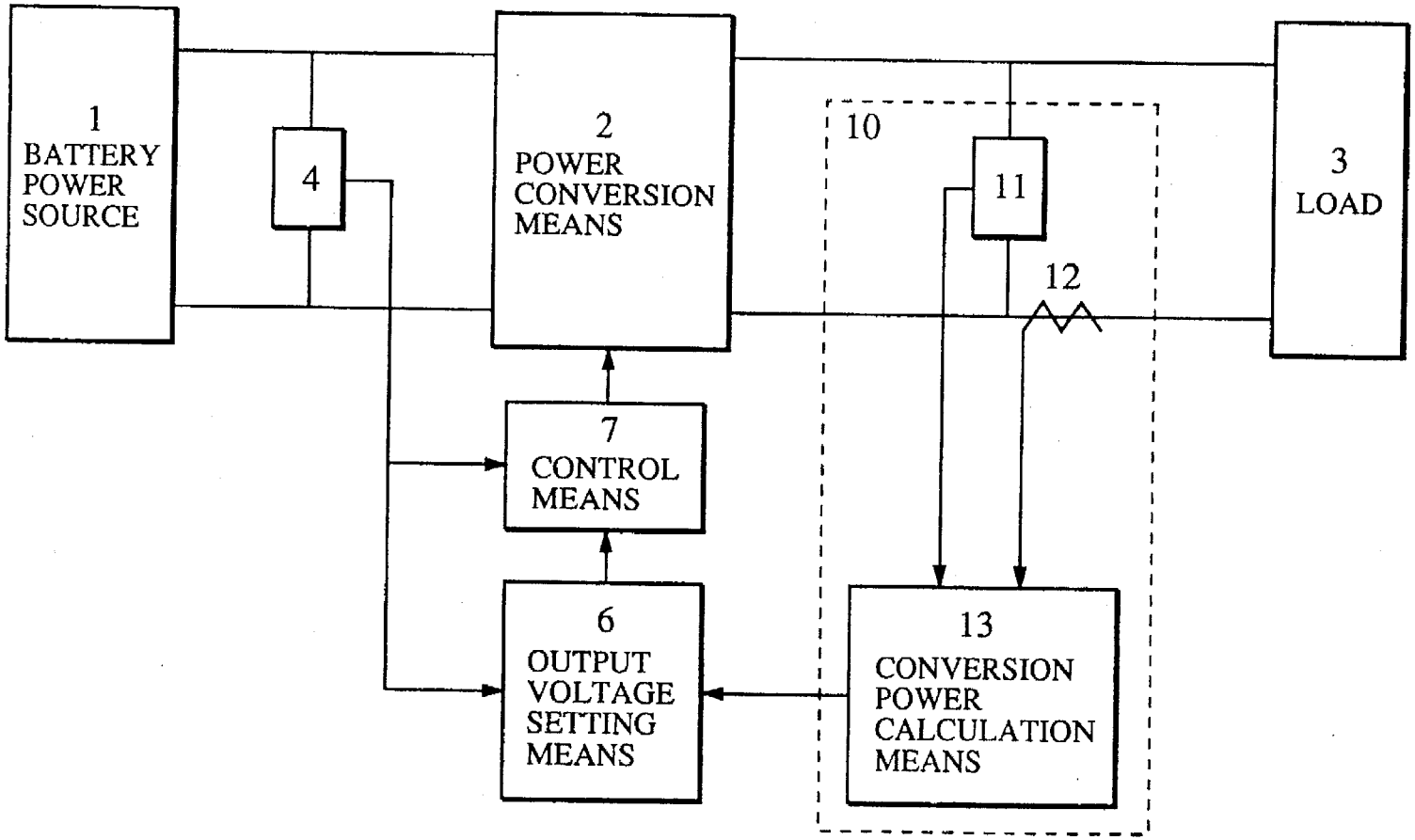
FIG. 9 is a schematic diagram illustrating another example of a battery power system using a power control method according to the present invention.

FIG. 9 is a schematic diagram illustrating a solar cell power generation system using a power control method according to the present embodiment of the invention. In this figure, similar elements to those in FIG. 1 are denoted by similar reference numerals to those in FIG. 1. The system shown in FIG. 9 has the following features. Unlike the system shown in FIG. 1, in the power control method of the present embodiment according to the invention, there is no need to detect the output current of the solar cell system. Instead, there is provided power detection means 10 for detecting the output power of a power conversion apparatus 2.

The power detection means comprises: conversion voltage detection means 11, for detecting the output voltage of the power conversion apparatus 2 (also called the conversion output voltage); conversion current detection means 12, for detecting the output current of the power conversion apparatus 2 (also called the conversion output current); and conversion power calculation means 13 for calculating the output power of the power conversion apparatus 2 (also called the conversion output power) and for outputting the value representing the conversion power. In the case where the power conversion apparatus 2 outputs AC power, the conversion power calculation means 13 detects the instantaneous voltage and current at the output of the power conversion apparatus 2, and then calculates the instantaneous power from these values. The output power is then determined by calculating the average value of the instantaneous power.

Referring to FIG. 2 again, there will be described a method of the present embodiment for searching the optimum operating point at which the output power has its maximum value in which the hill-climbing method is used. FIG. 2 illustrates the output characteristics at different times, in which the horizontal axis represent the voltage of the solar cell system, and the vertical axis represents the output power of the power conversion apparatus. In the description of embodiment 1, FIG. 2 has been used to illustrate the operation of the system, in which the vertical axis represents the output power of the solar cell. However, in the case of the present embodiment, it should be understood that the vertical axis represents the output power of the power conversion apparatus.

First, the operating point is set to voltage V1. Sampling is performed at time t1 so as to read voltage V1 and current I1 at the operating point (1).

Operating Point (1): Voltage=V1; Power=P1

Then, the operating point is set to V2, and voltage V2 and output power P2 are read at the next sampling time t2 (=t1+Ts).

Operating Point (2): Voltage=V2; Power=P2

The operating point is then set to voltage V1 again, and voltage V1 (=V3) and output power P3 at the operating point (3) are read at the next sampling time t3 (=t2+Ts).

Operating Point (3): Voltage=V3; Power=P3

Then, the variation in the intensity of solar radiation is estimated from the difference in power between two operating points having the same voltage V1. Since the output current or the output power of the solar cell system changes in proportion to the intensity of the solar radiation, as long as the output voltage is maintained constant, the output power of the power conversion apparatus 2 also changes in proportion to the intensity of the solar radiation, as long as the change in its input power remains small that can occur during a sampling interval. Therefore, the difference in the output power of the power conversion apparatus for the same output voltage indicates the change in the intensity of solar radiation that has occurred during the measuring interval. Thus, the power difference ΔP=P3–P1 represents the change in the intensity of solar radiation that has occurred during the interval from time t1 to time t3.

Therefore, the data is corrected using ΔP that includes the information representing the chage in the intensity of solar radiation.

Because the sampling interval Ts is as short as 1/30 sec, the intensity of solar radiation can be considered to change at a constant rate during the time interval from t1 to t3. In the vicinity of the operating point at which the output power has its maximum value, the difference between the output power at voltage V1 and the output power at voltage V2 is so small that the rate of the change in the output power due to the change in the intensity of solar radiation during a time interval of the order of the sampling interval Ts can be regarded as constant for both the operating points at V1 and V2. Therefore, power P2 at the operating voltage V2 at time t2 can be corrected to power P2' at the operating voltage V2 at time t3 by adding ΔP/2 to power P2 wherein ΔP/2 corresponds to the power change arising from the change in the intensity of solar radiation that has occurred during the time interval from t2 to t3.

$$P2'=P2+\Delta P/2$$

This corrected operating point is denoted by (2)' in FIG. 3.

Operating Point (2)': Voltage=V2; Power=P2'

Then, the power at the operating point (3) is compared with the power at the operating point (2)', and the next searching direction is determined from the result of the above comparison. Power P3 at the operating point (3) is greater than power P2' at the operating point (2)'. This means that the maximum power will be obtained at an operating voltage less than the operating voltage V1, which will lead to a decision that the next searching should be done in the direction that results in a reduction in voltage.

Figure 10:
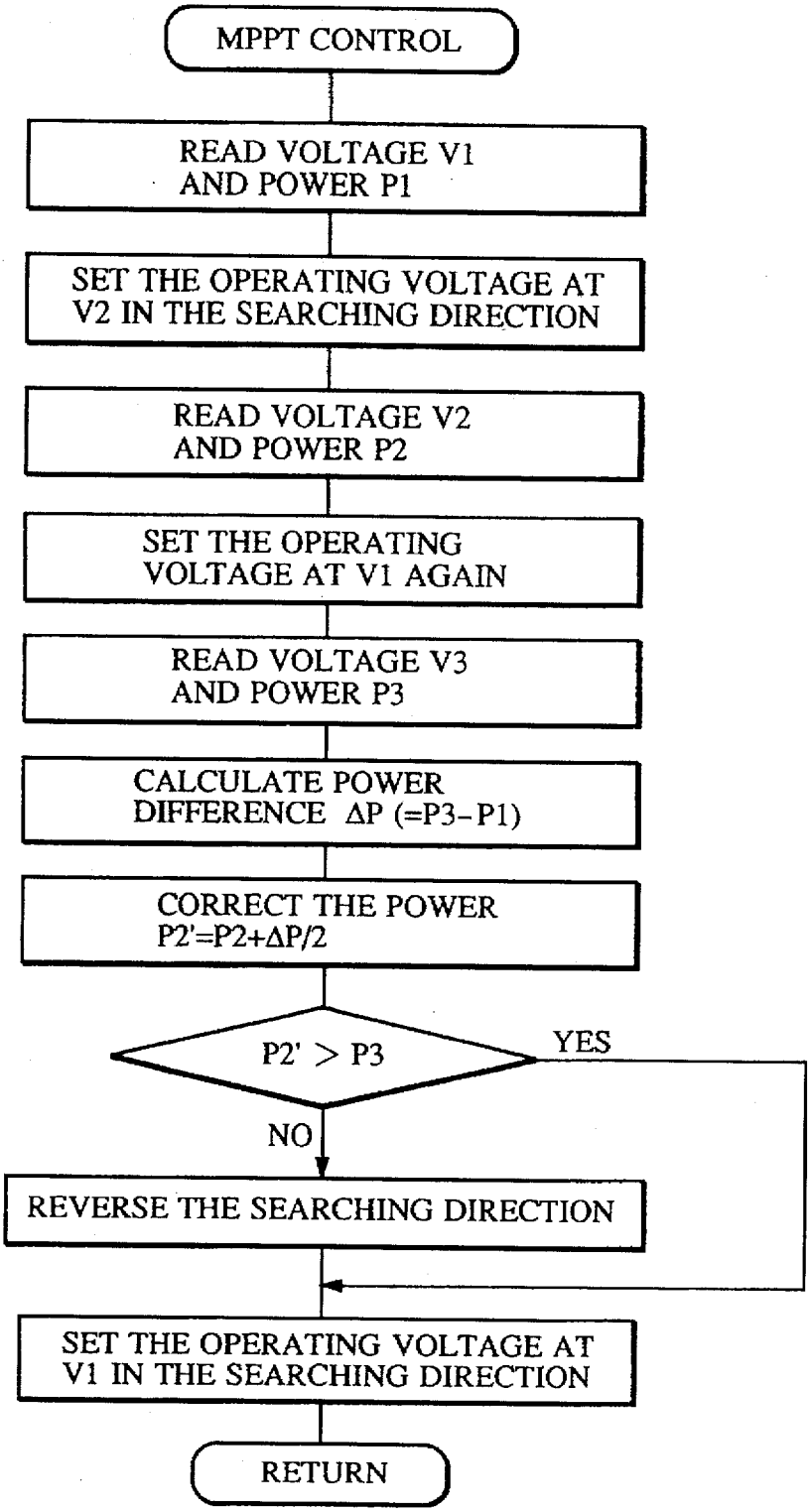
FIG. 10 is a flow chart illustrating the operation of the system shown in FIG. 9.

The above-described process is done repeatedly so that the operating point is always at the optimum point that produces the maximum power. FIG. 10 is a flow chart illustrating this process.

In the above example, the operation has been described referring to the case where the intensity of light increases. However, it will be apparent to those skilled in the art that the operating point is always at the optimum point that provides the maximum output power also in the case where the intensity of light decreases or remains unchanged.

In the present embodiment, as described above, the variation in the intensity of solar radiation is estimated from power values obtained at the same output voltage at different times, thereby obtaining correct data lying on a correct output characteristic curve at any given time. Since the searching direction is determined from the data obtained in this way, no erroneous operation occurs in the searching control even if the intensity of solar radiation varies. As a result, the system can extract the maximum power from a solar cell system without instability.

In this embodiment 4, since the system has the voltage detection means 4, for detecting the voltage of the solar cell, and the conversion power calculation means 13, for detecting the power via the power conversion apparatus 2, if the output values of the solar cell system 1 vary, the power conversion apparatus disposed at the output side of the solar cell system 2 is controlled such that the output power via the power conversion apparatus 2 always has a maximum value.

Embodiment 5

The fifth embodiment will now be described.

Figure 11:
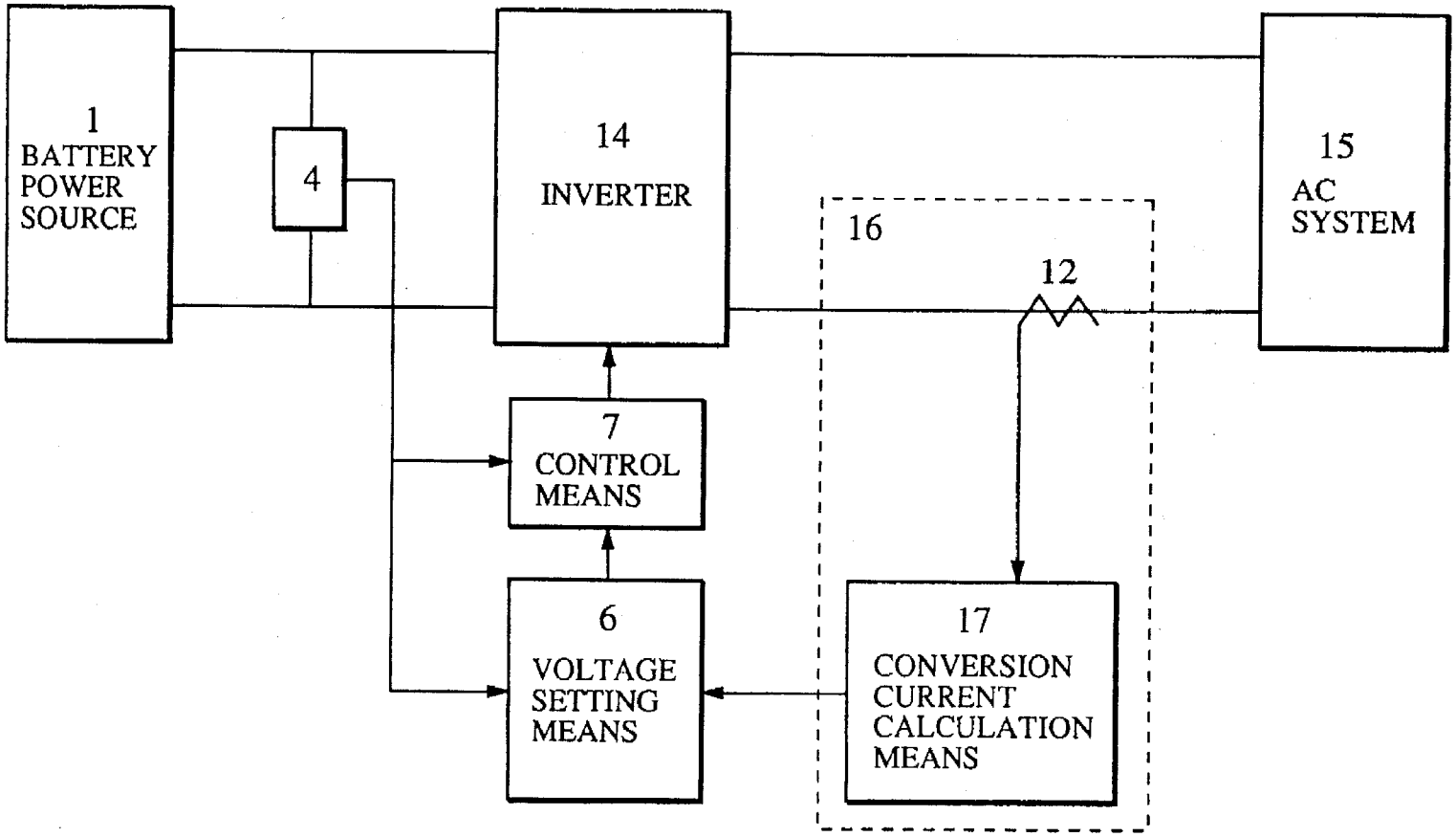
FIG. 11 is a schematic diagram illustrating still another example of a battery power system using a power control method according to the present invention.

FIG. 11 is a schematic diagram illustrating a solar electric power generation system in parallel operation with other systems, according to the present embodiment of the invention. This system shown in FIG. 11 is similar to that of FIG. 9. However, the power conversion apparatus 2 and the load 3 are an inverter 14 and an AC system 15, respectively, in this case. Furthermore, the voltage setting means 6 receives a current value detected by current detection means 16 instead of receiving detected output power of the power conversion apparatus. The current detection means 16 comprises conversion current detection means 12, for detecting an AC output current of the inverter 14 (also called conversion output current), and conversion current calculation means 17, for calculating the average current from instantaneous currents detected by the conversion current detection means 12, thereby outputting the resultant average output current of the inverter 14.

In this solar electric power generation system, the output of the inverter 14 is connected to the AC system in parallel operation. Since the voltage of the AC system is nearly constant, the output voltage of the inverter is maintained nearly constant. Therefore, if the power factor of the inverter output is constant (1, for example), the output power of the inverter has a maximum value when the output current of the inverter has a maximum value. Furthermore, the characteristic of the voltage of the solar cell versus the output current of the inverter is similar in shape to the characteristic of the voltage of the solar cell versus the output current of the solar cell. In this embodiment, an approximation algorithm using a quadratic curve is also employed as in embodiment 2.

Figure 12:
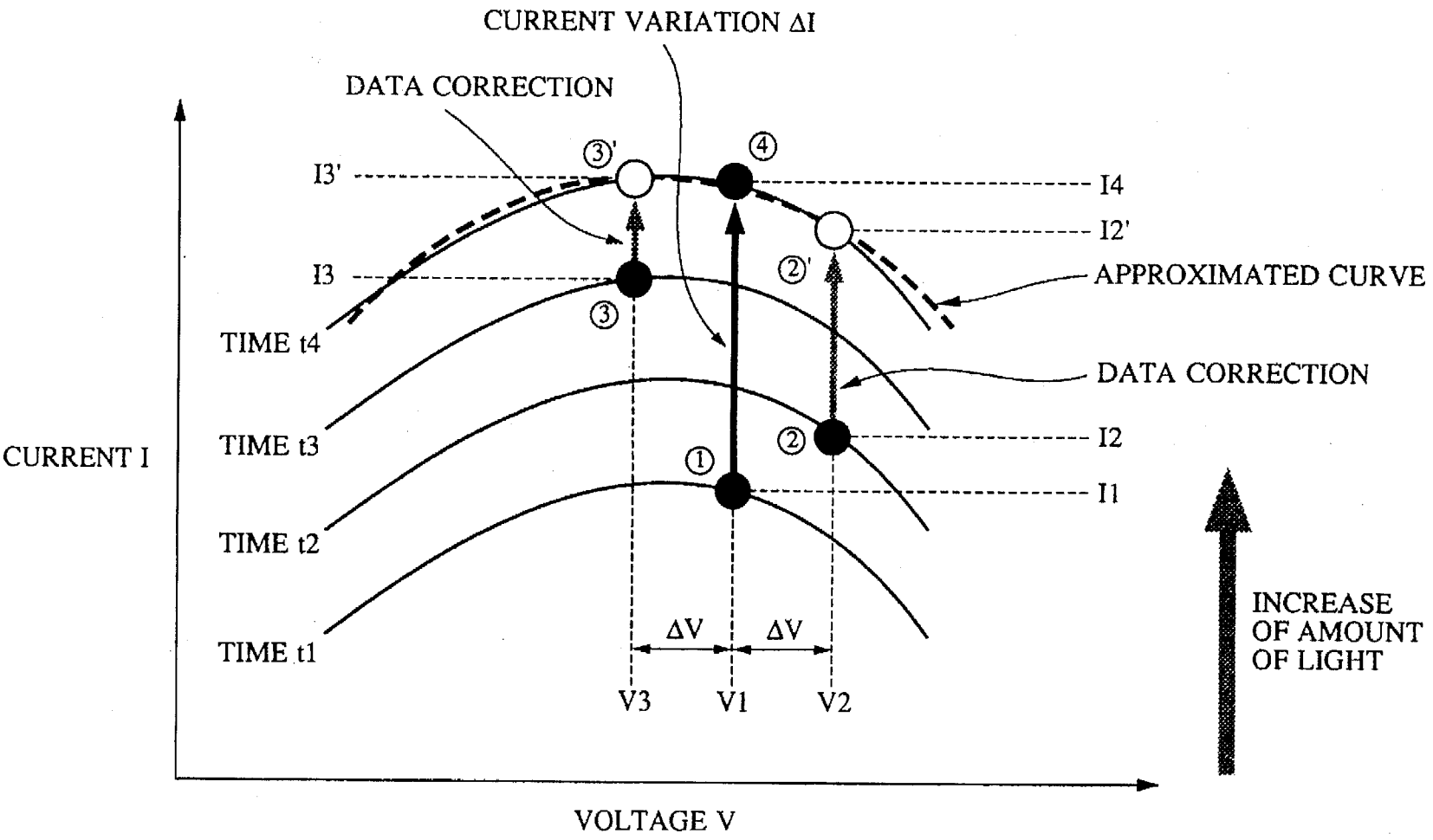
FIG. 12 is a graph illustrating another example of searching of an optimum operating point according to a power control method of the present invention.
Figure 13:
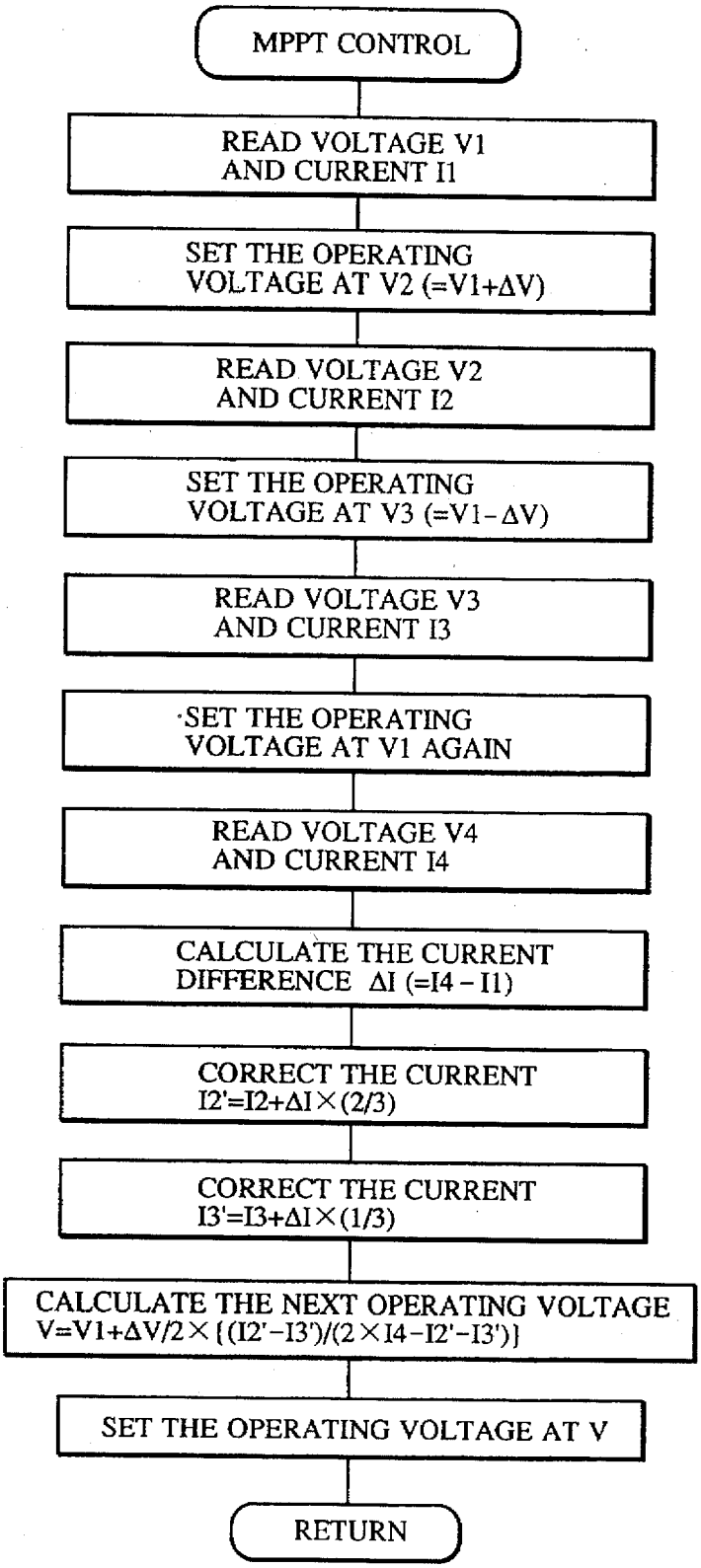
FIG. 13 is a flow chart illustrating the control process shown in FIG. 12.
Figure 14:
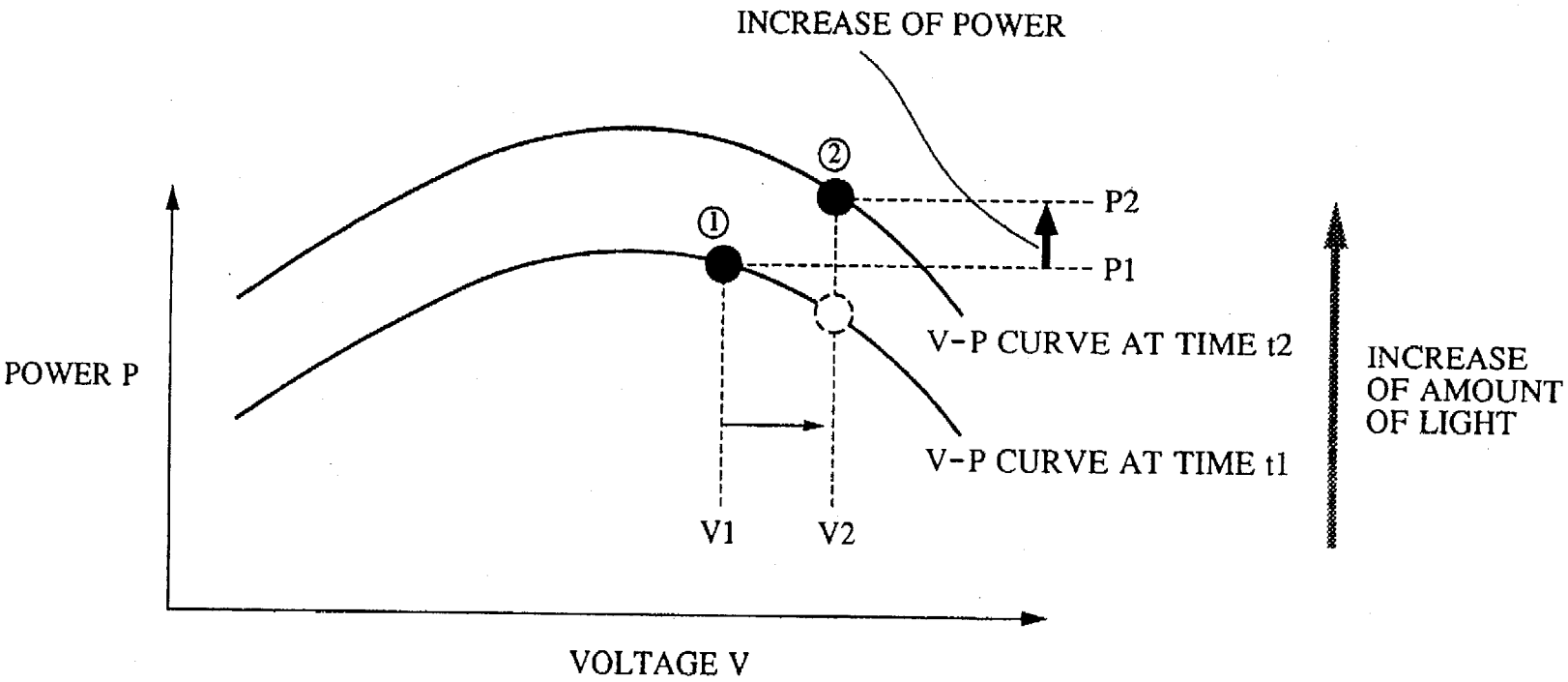
FIG. 14 PRIOR ART
FIG. 14 is a graph illustrating an example of searching of an optimum operating point according to a conventional power control method.

Referring to FIG. 12, the power control method in this embodiment will be described. FIG. 12 illustrates voltage versus current characteristic curves at various times, in which the horizontal axis represent the output voltage V of the solar cell, and the vertical axis represents the output current I of the inverter.

In a searching operation, the operating point is first set to voltage V1. Sampling is performed at time t1 so as to read voltage V1 of the solar cell at the operating point (1) and the output current I1 of the inverter.

Operating Point (1): Voltage=V1; Current=I1

Then, the operating point is set to V2 (=V1 +ΔV), and voltage V2 and current I2 at the operating point (2) are read at the next sampling time t2 (=t1 +Ts).

Operating Point (2): Voltage=V2; Current=I2

The operating point is then set to voltage V3 (=V1−ΔV), and voltage V3 and current I3 at the operating point (3) are read at the next sampling time t3 (=t2+Ts).

Operating Point (3): Voltage=V3; Current=I3

The operating point is then set to voltage V1 again, and voltage V4 and current I4 at the operating point (4) are read at the next sampling time t4 (=t3+Ts).

Operating Point (4): Voltage=V4; Current=I4

Then, the variation in the intensity of solar radiation is estimated from the difference in power between two operating points having the same voltage V1. That is, since the output power of the solar cell changes in proportion to the intensity of the solar radiation, as long as the output voltage is maintained constant, the output current of the inverter also changes in proportion to the intensity of the solar radiation if the output voltage and the power factor of the inverter are maintained constant. As a result, the difference in current for the same voltage indicates the change in the intensity of solar radiation that has occurred during the measuring interval. This means that the current difference ΔI=I4−I1 represents the change in the intensity of solar radiation that has occurred during the interval from time t1 to time t4.

In view of the above, the data is corrected using ΔI which includes the information representing the change in the intensity of solar radiation.

Because the sampling interval Ts is as short as 1/30 sec, the intensity of solar radiation can be considered to change at a constant rate during the time interval from t1 to t4. In the vicinity of the operating point at which the output power of the inverter has its maximum value, the difference in output current among voltages V1, V2 and V3 is so small that the rate of the change in the output power, due to the change in the intensity of solar radiation during a time interval of the order of the sampling interval Ts, can be regarded as constant for all operating voltages V1, V2 and V3.

Therefore, current I2 at the operating voltage V2 at time t2 can be corrected to power I2' at the operating voltage V2 at time t4 by adding ΔI×2/3, to current I2, wherein ΔI×2/3 corresponds to the current change arising from the change in the intensity of solar radiation during the time interval from t2 to t4.

$$I2'=I2+\Delta I\times(2/3)$$

This corrected operating point is denoted by (2)' in FIG. 12.

Operating Point (2)': Voltage=V2, Current=I2'

Furthermore, current I3 at the operating voltage V3 at time t3 can be corrected to current I3' at the operating voltage V3 at time t4 by adding ΔI×1/3 to current I3 wherein ΔI×1/3 corresponds to the current change arising from the change in the intensity of solar radiation during the time interval from t3 to t4.

$$I3'=I3+\Delta I\times(1/3)$$

This corrected operating point is denoted by (3)' in FIG. 12.

Operating Point (3)': Voltage=V3; Current I3'

The next operating voltage is determined from data associated with three operating points (2)', (3)' and (4) according to the following equation, as in embodiment 2.

$$V=V1+\Delta V/2\times\{(I2'-I3')/(2\times I4-I2'-I3')\}$$

The voltage determined from the above equation is used as a starting voltage in the next searching cycle.

The above-described process is done repeatedly so that the operating point is always at the optimum point that provides the maximum power.

In the above example, the operation has been described referring to the case where the intensity of light increases. However, it will be apparent to those skilled in the art that the operating point is always at the optimum point that provides the maximum output power also in the case where the intensity of light decreases or remains unchanged.

In the present embodiment, as described above, the variation in the intensity of solar radiation is estimated from current values obtained at the same voltage at different times, thereby obtaining correct data lying on a correct output characteristic curve at any given time. Since the starting voltage in the next searching cycle is determined from the data obtained in this way, no erroneous operation due to the change in the intensity of solar radiation occurs in the searching control. As a result, the system can extract the maximum power from a solar cell system without instability. In this fifth embodiment, the system includes voltage detection means 4, for detecting the voltage of the solar cell, and current detecting means 16, for detecting the average current, via the inverter 14, acting as a power conversion apparatus. There is no need for detecting the output voltage and output power of the inverter. Thus, a system constructed in a simple fashion, according to this embodiment, can always provide the maximum power via the inverter 14.

Embodiment 6

Figure 15:
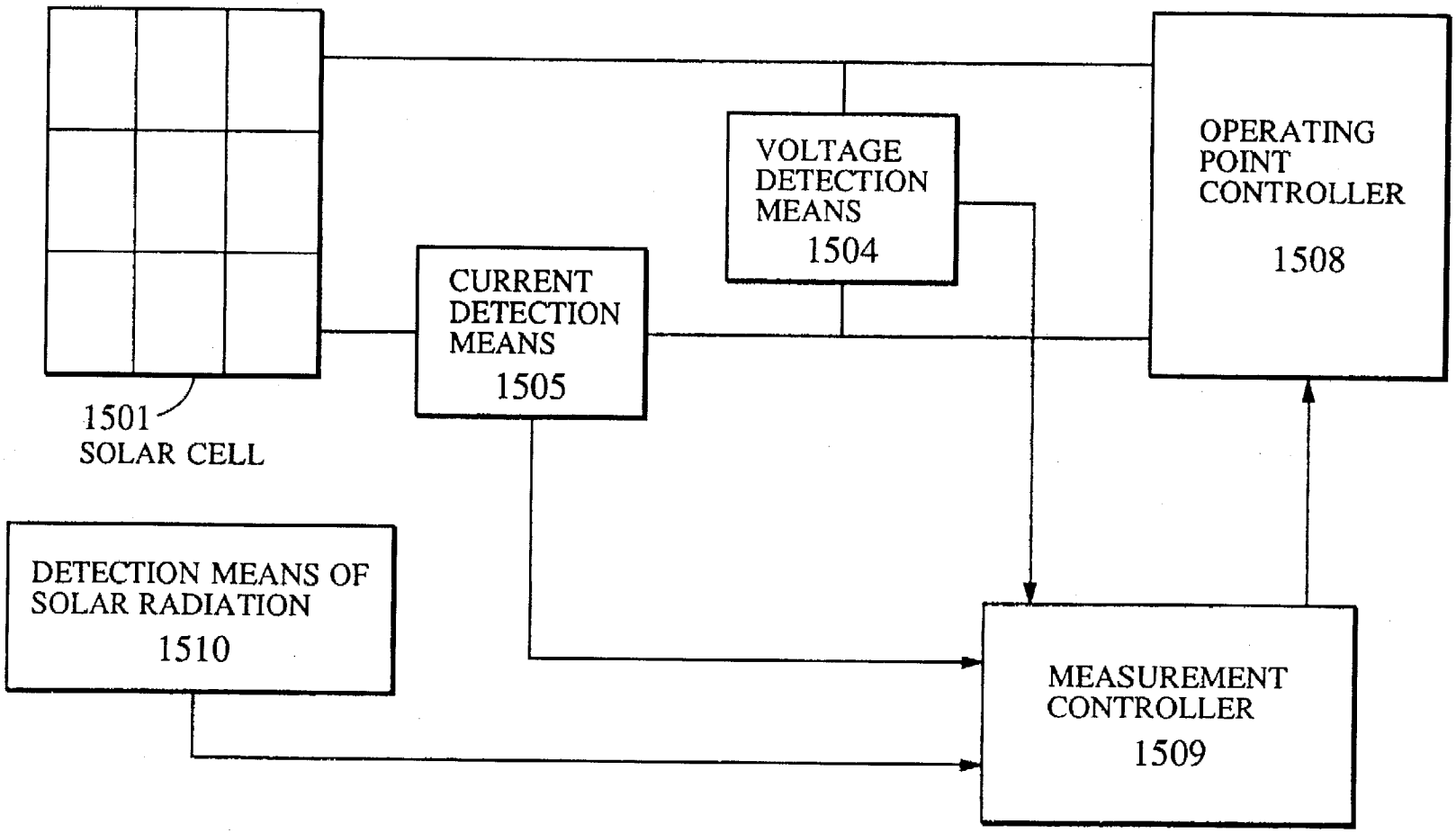
FIG. 15 is a schematic diagram illustrating a measurement system for measuring the voltage-versus-current characteristic of a solar cell, according to a measurement method of the present invention.

FIG. 15 illustrates a system for measuring the voltage-versus-current output characteristic of a solar cell according to a method of the sixth embodiment of the invention.

The output of a solar cell 1501 is connected to an operating point controller 1508. The output voltage and the output current of the solar cell 1501 are detected periodically by voltage detection means 1504 and current detection means 1505, respectively, and the obtained voltage and current signals are applied to a measurement controller 1509.

The operating point controller 1508, for controlling the operating point of the solar cell, is implemented by, for example, an electronic load that looks like a variable resistor when seen from the solar cell.

The voltage and current signals, and the solar-radiation intensity signal detected by solar-radiation detection means 1510, are applied to the measurement controller 1509. These detected signals are stored in it and used to calculate values associated with various characteristics (such as the conversion efficiency). The measurement controller 1509 also issues a command associated with a setting voltage to the operating point controller 1508.

The voltage detection means 1504, the current detection means 1505, and the operating point controller 1508, should be adequately selected such that they match the magnitudes of the voltage and current of the solar cell 1501.

With the above arrangement, the voltage-versus-current output characteristic of the solar cell is measured as follows.

First, the solar cell is made open, and the open-circuit voltage is measured. Then, the voltage corresponding to 5/100 of the detected open-circuit voltage is defined as ΔV. The voltage detection means 1504, and the current detection means 1505, perform measurements and send the obtained data to the measurement controller 1509 at intervals Ts equal to 2 ms.

First, the operating point controller 1508 sets the operating point to 0 V in response to a received command, that is, the solar cell is short-circuited, as shown in FIG. 16. At time t0, voltage V0 and current I0 are sampled. The voltage is then set to ΔV, and voltage V1 and current I1 are sampled at time t1 (=t0+Ts). The voltage is then set to 2ΔV, and voltage V2 and current I2 are sampled at time t2 (=t1 +Ts). Similarly, the voltage is sequentially set to increasing values 3ΔV, 4ΔV, . . . , iΔV, . . . while reading data (V3, I3), (V4, I4), . . . , (Vi, Ii), . . . , until the solar cell becomes open. At time t96 at which the solar cell has become open, data (V96, I96) and a solar-radiation intensity signal are detected. The voltage is then set to 95ΔV, and voltage V97 and current I97 are sampled at time t97. The voltage is then set to 94ΔV, and voltage V98 and current I98 are sampled at time t98. Similarly, the voltage is sequentially set to decreasing values 93ΔV, 92ΔV, . . . , (96–j)ΔV, . . . while reading data (V99 I99), (V100, I100), . . . , (V(96+j), I(96+j)), . . . , until the solar cell becomes short-circuited. At time t192 at which the solar cell has become short-circuited, data V192 and I192 are sampled. Thus, the process of reading data from the voltage detection means 1504, the current detection means 1505, and the operating point controller 1508 has been completed.

In the above measurement processing, if the intensity of solar radiation changes during a time duration from time t0 to t192, the changing rate of the intensity of solar radiation can be regarded as constant, since the duration is as short as 192Ts=384 ms. Furthermore, the output current of the solar cell changes in proportion to the intensity of solar radiation as long as the voltage is constant. Based on this fact, the measured data are corrected.

Voltage V(96–i) at time t(96–i) is set a value equal to voltage V(96+i) at time t(96+i), that is, V(96–i)=V(96+i). Therefore, if the current difference ΔIi=I(96+i)–I(96–i) is divided by the time interval 2iTs between these measuring points, then the current changing rate Xi (=ΔIi/2iTs), corresponding to the changing rate of the intensity of solar radiation during this time interval, is obtained. If the voltage were V(96–i) at time t96, the corresponding current I(96–i)' would be the average of I(96–i) and I(96+i) because time t96 is in the middle between t(96–i) and t(96+i) and the current changing rate Xi can be regarded as constant during this time interval. This means that a current for an arbitrary voltage at time t96 can be obtained by calculating the average value of two current values measured at the same voltage.

$$I(96-i)'=\{I(96-i)+I(96+i)\}/2$$

If the above calculation is done for each i=1 through 96, then currents at all points at time t96 can be obtained. The currents I(96–i)' calculated in this way form a set of data on the same I-V curve at the same time.

As described above, the influence of the change in the intensity of solar radiation can be eliminated by correcting each current from a plurality of current values at the same voltage. In this way, data lying on the same I-V curve at the same time can be obtained, that is, this method allows accurate measurement on the voltage-versus-current output characteristic of the solar cell.

In the above example, the sampling process is done in the order of the short-circuit state→open-circuit state→short circuit state. However, the sampling order is not limited to that order. For example, the sampling can also be done in the order of the open-circuit state→short-circuit state→open-circuit state. Furthermore, the present invention has been described referring to specific embodiments in which a solar cell is used as the battery power source. However, it will be apparent to those skilled in the art that the present invention can also be applied to other various types of battery power sources, having a similar output characteristic, whose output current changes in proportion to a certain variable when the voltage is maintained constant. As can be seen from the above description, the method and apparatus according to the present invention for controlling the power of a battery power source have the following features and advantages:

1. The optimum operating point at which the maximum power can be extracted from battery power source can be correctly searched regardless of the change in the intensity of solar radiation during the searching process.
2. The optimum operating point can be correctly searched regardless of the change in the intensity of solar radiation, and the resultant information associated with the optimum operating point is fed back to the system so that the system always operates at the optimum operating point determined. As a result, stable operation is achieved.
3. The sampling operation is done only twice at the same voltage, and thus it is possible to quickly search the optimum operating point with the minimum number of sampling operations.
4. In particular, if sampling operations for the same voltage are done first and last in each sampling cycle, more accurate correction can be performed on the data. The optimum operating point can be searched more accurately according to these accurate data.

The method of the present invention for measuring the voltage-versus-current characteristic has the following features and advantages:

1. Accurate measurement of the characteristic is always possible regardless of changes in conditions such as the intensity of solar radiation.
2. This method can be advantageously applied to automatic measurement (for example at intervals of 10 min) to obtain accurate data regardless of the change in the intensity of solar radiation.

As described above, the present invention is very useful in the control of the power and in the measuring of the characteristic. In particular, the present invention can be advantageously applied to a battery power system that operates in parallel with a commercial power system.

What is claimed is:

1. A power generating apparatus comprising:

a power conversion means for converting power supplied by a battery power source and supplying the converted power to a load;

output value detecting means for detecting an output value of the battery power source;

set voltage value setting means for setting an output value from the battery power source to a predetermined value; and controlling means for controlling said power conversion means in order for the output value from the battery power source to be the set output value of said set voltage value setting means, wherein said controlling means and set voltage value setting means control said power conversion means, such that: in a first step, in order for the voltage value of the battery power source detected by said output value detecting means to be made a predetermined value V1, said set voltage setting means sets the set output value to predetermined value V1, and said output value detecting means detects a power value P1 or current value I1 at that time;

in a second step, in order for the voltage value from the battery power source detected by said output value detecting means to be a predetermined value V2, which is equal to (V1+ΔV), said set voltage value setting means sets the set output value to predetermined value V2 and said output value detecting means detects a power value P2 or current value I2 at that time;

in a third step, in order for the voltage value from the battery power source detected by said output value detecting means to be predetermined value V1, which is the same value as in the first step, said set voltage setting means sets the set output value to predetermined value V1, and said output value detecting means detects a power value P3 or current value I3 at that time;

in a fourth step, said set voltage value setting means compares the power values P1 and P3 or current values I1 and I3, and obtains, based on the comparison, power change ΔP or current change ΔI;

in a fifth step, said set voltage value setting means obtains a corrected electric power value P2' or a corrected current value I2' from the power value P2 and the power change ΔP, or from the current value I2 and the current change ΔI; and in a sixth step, said set voltage value setting means compares the electric power value P3 and the corrected power value P2' or the current value I3 and the corrected current value I2', and when the corrected power value P2' is larger than the power value P3 or when the corrected current value I2' is larger than the current value I3, continues searching the most desirable power value or current value in the direction of additional voltage (+ΔV) to the predetermined value V2 used in the second step, and when the corrected power value P2' is not larger than the power value P3, or when the corrected current value I2' is not larger than the current value I3, said controlling means controls said power conversion means so that the search for the most desirable power value or current value is performed in the direction of voltage decrease (−ΔV) to the predetermined value V2 used in the second step.

2. An apparatus according to claim 1, wherein the battery power source is a power source having a solar cell.

3. An apparatus according to claim 1, wherein the load is a commercial communication system.

4. An apparatus according to claim 1, wherein the operating intervals of the first step operation, the second step operation and the third step operation are constant.

5. An power generating apparatus comprising:

power conversion means for converting power supplied by a battery power source and supplying the converted power to a load;

output value detecting means for detecting an output value of the battery power source;

set voltage value setting means for setting a output value from the battery power source to a predetermined value; and controlling means for controlling said power conversion means in order for the output value from the battery power source to be the set output value of said set voltage value setting means, wherein said controlling means and set voltage value setting means control said power conversion means, such that: in a first step, in order for the voltage value of the battery power source detected by said output value detecting means to be predetermined value V1, said set voltage value setting means sets the set output value to predetermined value V1, and said output detecting means detects a power value P1 or current value I1 at that time;

in a second step, in order for the voltage value from the battery power source detected by said output value detecting means to be a predetermined value V2, which is equal to (V1+ΔV), said set voltage setting means sets the set output value to predetermined value V2, and said output value detecting means detects a power value P2 or current value I2 at that time;

in a third step, in order for the voltage value from the battery power source detected by said output value detecting means to be a predetermined value V3, which is equal to (V1−ΔV), said set voltage value setting means sets the set output value to predetermine value V3, and said output value detecting means detects a power value P3 or current value I3;

in a fourth step, in order for the voltage value from the battery power source detected by said output value detecting means to be predetermined value V1, which is the same as predetermined value V1, said set voltage value setting means sets the set output value to predetermined value V1, and said output value detecting means detects a power value P4 or current value I4;

in a fifth step, said set voltage value setting means compares the power values P1 and P4 or current values I1 and I4, and obtains, based on the comparison, a electric power change ΔP or current change ΔI;

in a sixth step, said set voltage value setting means obtains a first corrected power value P2' or a first corrected current value I2' from the power value P2 and power change ΔP, or from the current value I2 and current change ΔI;

in a seventh step, said set voltage value setting means obtains a second corrected power value P3' of a second corrected current value I3' from the power value P3 and power change ΔP or the current value I3 and current change ΔV; and in an eighth step, set voltage value setting means obtains a curve function formula in which the power value and the current value are approximate values, or a curve function formula in which the current value and the voltage value are approximate values, based on the power value P4, the first corrected power value P2' and the second corrected power value P3' or the current value I4, the first corrected current value I2' and the second corrected current value I3', and said set voltage value setting means further obtains the maximum power value or current value from the curve function formula, and said controlling means controls said power conversions means so that the maximum value is output from the battery power source.

6. An apparatus according to claim 5, wherein the curve function formula is a quadratic function.

7. An apparatus according to claim 5, wherein the battery power source is a power source having a solar cell.

8. An apparatus according to claim 5, wherein the load is a commercial communication system.

9. An apparatus according to claim 5, wherein the operating intervals of the first step operation, second step operation, third step operation and fourth step movement are constant.

* * * * *

UNITED STATES PATENT AND TRADEMARK OFFICE

CERTIFICATE OF CORRECTION

PATENT NO. : 5,682,305

DATED : October 28, 1997

INVENTOR(S) : SEIJI KUROKAMI, ET AL.

It is certified that error appears in the above-identified patent and that said Letters Patent is hereby corrected as shown below:

COLUMN 1

Line 20, "an" should read --a--.

COLUMN 2

Line 36, "shutdown" should read --shut down--.

COLUMN 11

Line 66, "represent" should read --represents--.

COLUMN 12

Line 65, "current" should read --current detection--; and
Line 67, "detection" should read --detecting--.

COLUMN 13

Line 41, "represent" should read --represents--.

COLUMN 14

Line 18, "chage" should read --change--.

COLUMN 15

Line 49, "represent" should read --represents--.

UNITED STATES PATENT AND TRADEMARK OFFICE

CERTIFICATE OF CORRECTION

PATENT NO. : 5,682,305

DATED : October 28, 1997

INVENTOR(S) : SEIJI KUROKAMI, ET AL.

It is certified that error appears in the above-identified patent and that said Letters Patent is hereby corrected as shown below:

COLUMN 16

Line 39, "power" should read --current--.

COLUMN 18

Line 21, "V99" should read --V99,--.

COLUMN 20

Line 61, "a" should read --an--.

COLUMN 21

Line 21, "predetermine" should read --predetermined--; and
Line 34, "a" should read --an--.

COLUMN 22

Line 22, "conversions" should read --conversion--.

Signed and Sealed this

Twenty-third Day of June, 1998

*Attest:*

*Attesting Officer*

BRUCE LEHMAN

*Commissioner of Patents and Trademarks*